US006360070B1

(12) United States Patent
Taka et al.

(10) Patent No.: US 6,360,070 B1
(45) Date of Patent: Mar. 19, 2002

(54) IMAGE FORMING APPARATUS INCLUDING A PLURALITY OF CLOSELY SPACED TRANSFER STATIONS FOR SEQUENTIALLY TRANSFERRING ALIGNED, SUPERIMPOSED IMAGE PORTIONS TO A PRINTING MEDIUM

(75) Inventors: Kyosuke Taka; Kazunobu Takahashi, both of Nara; Hidekazu Sakagami, Sakurai; Nobuo Manabe, Yamatokoriyama; Yoshikazu Harada, Nara; Shoichi Fukutome, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/431,478

(22) Filed: Nov. 1, 1999

(30) Foreign Application Priority Data

| | | |
|---|---|---|
| Nov. 2, 1998 | (JP) | 10-312214 |
| Dec. 14, 1998 | (JP) | 10-354935 |
| Dec. 22, 1998 | (JP) | 10-364080 |

(51) Int. Cl.[7] ..... G03G 15/01

(52) U.S. Cl. ..... 399/301; 399/40; 399/231; 399/299; 399/306

(58) Field of Search ..... 399/301, 223, 399/231, 299, 300, 306, 40

(56) References Cited

U.S. PATENT DOCUMENTS

| | | | | |
|---|---|---|---|---|
| 6,070,041 A | * | 5/2000 | Nakayasu et al. | 399/301 |
| 6,173,141 B1 | * | 1/2001 | Sakagami et al. | 399/167 |

FOREIGN PATENT DOCUMENTS

| | | |
|---|---|---|
| JP | 62-129873 | 6/1987 |
| JP | 63-11965 | 1/1988 |
| JP | 63-286864 | 11/1988 |
| JP | 8-14731 | 2/1996 |

* cited by examiner

*Primary Examiner*—Quana M. Grainger
(74) *Attorney, Agent, or Firm*—Dike, Bronstein, Roberts & Cushman IP Group; David G. Conlin; Davis A. Tucker

(57) ABSTRACT

Assuming the photosensitive drum for black as a reference, the phase of the adjacent photosensitive drum for cyan leads by about 60 deg. Similarly, the phase of the photosensitive drum for magenta leads by about 120 deg., and the phase of the photosensitive drum for yellow leads by about 180 deg. The phase of each photosensitive drum is shifted to thereby make it possible to shift the phase of driving unevenness. By shifting the phase, even the distance between adjoining transfer positions corresponding to the image forming stations is set shorter than the circumference of the photosensitive drum, the variation of each photosensitive drum due to driving unevenness with respect to the printing medium passing through the transfer position can be kept congruent with the others.

27 Claims, 13 Drawing Sheets

IMAGE FORMING APPARATUS INCLUDING A PLURALITY OF CLOSELY SPACED TRANSFER STATIONS FOR SEQUENTIALLY TRANSFERRING ALIGNED, SUPERIMPOSED IMAGE PORTIONS TO A PRINTING MEDIUM

BACKGROUND OF THE INVENTION (1) Field of the Invention

The present invention relates to an image forming apparatus in which a printing medium is supported and conveyed by a conveyer and transfer belt which abuts the transfer area surface of the rotationally driven image bearer (photosensitive drum), with a predetermined positional relationship so that the toner image formed on the image bearer is transferred to and reproduced on the printing medium. More detailedly, the present invention relates to an image forming apparatus in which the image bearer is controlled so that it stops with a predetermined positional relationship when it is stopped to thereby become ready for subsequent image formation with precision.

(2) Description of the Prior Art

Conventionally, color image forming apparatus have been known in which a color image is transferred as image data of YMCK components to the recording portion whereby the color image is reproduced by forming color separations of the image and successively superimposing them one over another. So, color image forming apparatus of this type suffer from the problem in that a correct color image cannot be reproduced if each color separation cannot be exactly laid over the others. Therefore, how this problem is handled is the key to the technical development of this field.

In the image forming apparatus having a large number of parts, each part has small variations in precision. Further, individual image forming apparatus present variations in the assembly accuracy when these parts are assembled.

To deal with this, a configuration has been known conventionally, which forms trial color-separated pattern images and checks the positional relationship between these color separated pattern images to perform registration adjustment to image forming positions for individual component color image formations (c.f. Japanese Patent Application Laid-Open Sho 63 No. 286864).

Though it was possible to compensate for 'color misregistration' due to 'deviations of the start-position of writing of individual images' by the execution of the aforementioned registration adjustment, it was impossible to correct the color misregistration attributed to the irregular speed variations of the photosensitive drums which are caused by periodic driving irregularities of the drive system, of drive gears etc. for driving the photosensitive drums.

Actually, the image forming apparatus of this kind has conventionally suffered from periodic driving unevenness in different recording portions. Due to the occurrence of the periodic driving unevenness in individual recording portions, the image forming apparatus has the problem of color misregistration arising when the images recorded with different coloring matters are sequentially superimposed one over another to reproduce a color image, making it impossible to reproduce a correct color image.

To deal with this, in the conventional color image forming apparatus, in order to synchronize the behavior of each photosensitive drum due to the driving unevenness when the images formed on the photosensitive drum in individual recording portions are transferred at in their transfer stations, arrangement of the image forming system has been manipulated in such a geometry that the distance (time) from the position of image recording to one photosensitive drum to its transfer position is set equal to N times (N is an integer) of the cycle period of the driving unevenness of the driving mechanism (see Japanese Patent Application Laid-Open Sho 62 No.129873 and Japanese Patent Application Laid-Open Sho 63 No.11965).

FIG. 1 shows a configuration of image forming portions and a conveyer and transfer belt and thereabout for transferring the images formed in the individual image forming portions in a conventional color image forming apparatus using the above technique.

In FIG. 1, photosensitive drums 322*a*, 322*b*, 322*c* and 322*d*, constitute the recording portions for black, cyan, magenta and yellow, from the right to left. The images of different colors formed on these photosensitive drums 322*a* to 322*d* are transferred, sequentially from black, onto the printing medium supported and conveyed by conveyer and transfer belt 316, at the transfer areas A where photosensitive drums 322*a* to 322*d* are located close to conveyer and transfer belt 316.

Here, photosensitive drums 322*a* to 322*d* are adapted to start rotating simultaneously and are attached in such an arrangement that the behavior of rotational driving unevenness is in phase with each other.

As an illustrative example, the driving gears (not shown) are fitted on the shafts of photosensitive drums 322*a* to 322*d* so that certain references (for example, keyhole shaped holes ha shown in FIG. 1) indicating the phase of the driving unevenness are oriented in the same direction. By this arrangement, photosensitive drums 322*a* to 322*d* will rotate with their driving unevenness always in phase if they are started simultaneously.

Therefore, when the distance L' between transfer areas A as to photosensitive drums 322*a* to 322*d* is set so that $$L'=N\pi d \ldots \text{(N is an integer)}$$

where d is the diameter of each photosensitive drum 322*a* to 322*d*, in the image transfer process at each transfer area A of the four photosensitive drums 322*a* to 322*d* arranged in parallel to each other, images of different colors will be sequentially superimposed one over another with their behavior of the driving unevenness always being harmonized with respect to the printing medium. As result, it is possible to eliminate color misregistration due to driving unevenness.

However, in an image forming apparatus having a large number of parts, each part has small variations in precision. Or, individual image forming apparatus present variations in the assembly accuracy when these parts are assembled. Further, in the above configuration, the recording portions arranged in parallel to each other have to be arranged with their distances set in conformity with the periodic driving variations. So, when the recording portions are set with their distance from one to the next in conformity with the periodic driving variations, even with an integer N equal to 1, the distance at least needs to be equal to the circumference of the photosensitive drum. As a result, the image forming apparatus itself becomes bulky, in contrast to the user's demands for downsizing. In particular, this problem is markedly significant in an image forming apparatus having four photosensitive drums of component colors Y, M, C and Bk, as stated above.

In the conventional apparatus shown in FIG. 1, in order to reduce the friction between the photosensitive drums and the conveyer and transfer belt as low as possible, photosensitive drums 322*a* to 322*d* start and stop rotating simultaneously. Further, in order to suppress the appearance of the driving unevenness derived from the driving system of the photosensitive drums, the start-position or behavior of driving unevenness in each photosensitive drum relative to conveyer and transfer belt 316 is kept in phase with that of the others so that photosensitive drums 322*a* to 322*d* start and stop rotating from their reference positions keeping the positional relationship between the drums and the conveyer and transfer belt 316 constant.

However, it is impossible to start and stop the movements of photosensitive drums 322*a* to 322*d* and conveyer and transfer belt 316 for the transfer operation, completely in synchronism. The time lag of the rotation and stoppage will impart a large contact friction to the delicate surfaces of the photosensitive drums around their reference positions. Thus, repetitions of the contact friction promotes damage to the surfaces of the photosensitive drums around the reference positions and consequently, a duplicated image degrades at the corresponding position, so the photosensitive drums have to be replaced in spite of their partial damage.

In connection with this, the damage around the reference position will build up with the passage of time and gradually present periodic image unevenness in the transferred image. So it is difficult to distinguish the defect from that from the aforementioned driving unevenness. In particular, it was very difficult to determine the cause of image unevenness if irregularities appear at the position corresponding to the aforementioned reference position of the driving unevenness.

SUMMARY OF THE INVENTION

It is therefore an object of the present invention to provide an image forming apparatus which can produce a correct reproduction of a color image by adaptively managing the periodic driving variations in the recording portions arranged in parallel to each other and which is compact in size having a minimum footprint for installation in office environments.

It is another object of the invention to provide an image forming apparatus which can suppress damage to the photosensitive drum surfaces, has improved efficiency and is economical, as well as being excellent in maintainability with respect to image unevenness.

In order to achieve the above objects, the present invention is configured as follows:

In accordance with the first aspect of the invention, an image forming apparatus wherein images formed on the surfaces of multiple image bearers arranged in parallel to each other and rotationally driven are sequentially transferred in a superimposed manner to a printing medium conveyed by a printing medium-conveyance unit at transfer stations each set up for individual image bearers, is characterized in that the distance between adjoining transfer stations is set shorter than the circumference of the image bearer and each image bearer is rotationally driven such that phase of rotational driving unevenness of each image bearer is shifted for compensating for the shortening of the distance between transfer stations so that periodic, rotational driving unevenness of each image bearer produces the same variation with respect to the printing medium passing through the transfer station.

In accordance with the second aspect of the invention, the image forming apparatus having the above first aspect is characterized in that each of the image bearers or each of the rotating members rotating in harmony with the rotation of the image bearer has a reference mark which enables identification of the phase of periodic driving unevenness of the image bearer, further comprising a controller for controlling rotational driving of all the image bearers based on the reference marks.

In accordance with the third aspect of the invention, the image forming apparatus having the above second aspect is characterized in that the controller stops rotations of individual image bearers at their respective stop-positions based on the reference marks and starts rotations of all the image bearers simultaneously.

In accordance with the fourth aspect of the invention, the image forming apparatus having the above third aspect, further comprises: detectors for detecting the reference marks, wherein each detector is arranged in the same geometry with respect to the corresponding transfer station, and is characterized in that the controller detects the reference mark of one image bearer as a reference for positioning and stops the reference image bearer at a point when a predetermined margin period of time has elapsed after the detection of the reference mark of the reference image bearer, and detects the reference marks of the other image bearers so as to determine the amounts of correction by comparing the time at which each detector detects its reference mark with the time at which the reference mark of the reference image bearer is detected, and stops each image bearer at a point when the sum of the predetermined margin period of time and the amount of correction has elapsed.

In accordance with the fifth aspect of the invention, the image forming apparatus having the above third or fourth aspect is characterized in that each image bear is provided with an individual driver source for driving its rotation independently from the others and each driver source uses a stepping motor or servomotor.

In accordance with the sixth aspect of the invention, the image forming apparatus having the above third through fifth aspect is characterized in that a stop-position adjuster for adjusting the stop-position of each image bearer is provided separately.

In accordance with the seventh aspect of the invention, an image forming apparatus wherein images formed on the surfaces of multiple image bearers arranged in parallel to each other and rotationally driven are sequentially transferred in a superimposed manner to a printing medium conveyed by a printing medium-conveyance unit at transfer stations each set up for individual image bearers, is characterized in that the distance between adjoining transfer stations is set shorter than the circumference of the image bearer and each image bearer is stopped such that phase of rotational driving unevenness of each image bearer is shifted for compensating for the shortening of the distance between transfer stations so that periodic, rotational driving unevenness of each image bearer produces the same variation with respect to the printing medium passing through the transfer station, and a controller is provided which controls each image bearer so that each image bearer will stop at the predetermined stop-position when there occurs a factor that varies the stop-positions of the image bearers.

In accordance with the eighth aspect of the invention, the image forming apparatus having the above seventh aspect is characterized in that the factor that varies the stop-positions of the image bearers is the case where the power to the apparatus is activated.

In accordance with the ninth aspect of the invention, the image forming apparatus having the above seventh aspect is characterized in that the factor that varies the stop-positions of the image bearers is the periodic check of the apparatus.

In accordance with the tenth aspect of the invention, the image forming apparatus having the above seventh aspect is characterized in that the factor that varies the stop-positions of the image bearers is the case where an abnormally fed printing medium within the apparatus is removed.

In accordance with the eleventh aspect of the invention, the image forming apparatus having the above seventh aspect is characterized in that the factor that varies the stop-positions of the image bearers is the case where the printing medium-conveyance unit has been separated and returned with respect to the image bearer surfaces.

In accordance with the twelfth aspect of the invention, the image forming apparatus having the above seventh aspect is characterized in that the factor that varies the stop-positions of the image bearers is the case where the predetermined number of image recording operation has been performed.

In accordance with the thirteenth aspect of the invention, the image forming apparatus having the above seventh aspect is characterized in that image formation is performed in a mode which uses at least one of a plurality of recording portions, and the controller controls so that the image bearer in each recording portion stops at the predetermined stop-position after recording of an image using at least one of a plurality of recording portions.

In accordance with the fourteenth aspect of the invention, the image forming apparatus having the above thirteenth aspect is characterized in that the controller controls so that the image bearer in each recording portion stops at the predetermined stop-position after recording of an image using the recording portion for image recording of a black developer.

In accordance with the fifteenth aspect of the invention, the image forming apparatus having the above seventh aspect is characterized in that the controller controls so that the image bearer in each recording portion stops at the predetermined stop-position with the printing medium-conveyance unit retracted from the image bearers.

In accordance with the sixteenth aspect of the invention, an image forming apparatus comprises: a rotationally driven image bearer; and a printing medium-conveyance unit abutted against the image bearer, wherein a developer image formed on the image bearer is transferred to a printing medium by passing the printing medium through the nip between the printing medium-conveyance unit and the image bearer, and is characterized in that a first abutment position on the surface of the image bearer against the printing medium-conveyance unit when the image bearer starts rotating differs from a second abutment position on the surface of the image bearer against the printing medium-conveyance unit when the image bearer stops rotating.

In accordance with the seventeenth aspect of the invention, an image forming apparatus comprises: a multiple number of rotationally driven image bearers; and a printing medium-conveyance unit abutted against the image bearers forming transfer stations, wherein developer images formed on the image bearers are transferred to a printing medium passing through the transfer stations so that the images are sequentially superimposed, and is characterized in that each image bearer is rotationally driven such that phase of rotational driving unevenness of each image bearer is shifted from others so that periodic, rotational driving unevenness of the image bearer produces the same variation as that of the others with respect to the printing medium passing through the transfer stations, and a first abutment position on the surface of each image bearer against the printing medium-conveyance unit when the image bearer starts rotating differs from a second abutment position on the surface of the image bearer against the printing medium-conveyance unit when the image bearer stops rotating.

In accordance with the eighteenth aspect of the invention, the image forming apparatus having the above seventeenth aspect is characterized in that the first abutment position of the image bearer of which the surface is likely to be most severely damaged among all the image bearers is set different from the second abutment position while the rest image bearers are stopped with their phases shifted from each other in the predetermined relationship.

In accordance with the nineteenth aspect of the invention, the image forming apparatus having any one of the above sixteenth through eighteenth aspect is characterized in that the first and second abutment positions are altered every predetermined number of stops or starts of driving of the plural image bearers.

In accordance with the twentieth aspect of the invention, an image forming apparatus comprises: a rotationally driven image bearer; and a printing medium-conveyance unit abutted against the image bearer, wherein a developer image formed on the image bearer is transferred to a printing medium by passing the printing medium through the nip between the printing medium-conveyance unit and the image bearer, and a controller is provided which controls the rotation of the image bearer in such a manner that the abutment position on the surface of the image bearer against the printing medium-conveyance unit when the image bearer starts rotating is altered every time the predetermined number of stops or starts of driving of the image bearer is reached.

In accordance with the twenty-first aspect of the invention, an image forming apparatus comprises:

a first controller having a sensor which detects a reference mark rotating in harmony with the rotation of an image bearer and controlling the image forming process for the image bearer based on the detected result from the sensor; and a second controller controlling the stop-position of the image bearer based on the detected result from the sensor so that the reference mark is positioned in the predetermined relationship with respect to the sensor.

In accordance with the twenty-second aspect of the invention, the image forming apparatus having the above twenty-first aspect is characterized in that the reference mark is attached on the image bearer surface.

In accordance with the twenty-third aspect of the invention, the image forming apparatus having the above twenty-second aspect is characterized in that the reference mark is attached between a conductive supporting member and photoconductive layer constituting the image bearer.

In accordance with the twenty-fourth aspect of the invention, the image forming apparatus having the above twenty-first aspect is characterized in that the reference mark is attached on a drive transmission member for transmitting a rotational driving force to the image bearer.

In accordance with the twenty-fifth aspect of the invention, the image forming apparatus having the above twenty-first aspect, further comprises a controller for switching the stop-position of the image bearer, periodically.

In accordance with the twenty-sixth aspect of the invention, the image forming apparatus having the above twenty-first aspect, further comprises a driving mechanism for supporting the image bearer and transmitting a rotational driving force to the image bearer, wherein the image bearer is supported in the predetermined relationship with respect to the driving mechanism.

In accordance with the twenty-seventh aspect of the invention, the image forming apparatus having the above twenty-sixth aspect, further comprises a checking member for checking whether the sensor can detects the reference mark attached on the image bearer when a new image bearer is supported with respect to the driving mechanism.

In accordance with the twenty-eighth aspect of the invention, the image forming having the above twenty-sixth or twenty-seventh aspect is characterized in that when the sensor detects the reference mark attached to the image bearer, the image bearer stop-position control by the second controller is performed whereas if the sensor cannot detect the reference mark, the image bearer stop-position control by the second controller will not be performed.

According to the invention defined by the first aspect, since the distance between the adjacent transfer stations is set shorter than the circumference of the image bearer, it is possible to make the apparatus compact as compared to the conventional configuration where N=1. Further, the phase angle of each image bearer is rotated and shifted out of phase from the others for compensating for the above shortening, so that periodic, rotational driving unevenness of each image bearer produces the same variation with respect to the printing medium passing through the successive transfer stations. Therefore, the images formed on different image bearers can be sequentially superimposed under the same condition without having any influence of periodic driving unevenness of the image bearers. Hence, the final output image can be reproduced correctly without color misregistration.

According to the invention defined by the second aspect, the aspect of the first invention can be easily attainted by controlling the driving of each image bearer based on its reference mark (any mark will make do as a reference such as a cutout in the gear shaft or the like) which enables identification of the phase of periodic driving unevenness of the image bearer.

According to the invention defined by the third aspect, the following advantage can be obtained. In general, all the image bearers are started to rotate at the same time and stopped at the same time. This is to prevent the image bearers from being damaged by their friction with the printing medium-conveyance unit (conveyer and transfer belt). Even if the rotation of each image bearer is started and stopped at different timing from the others, there is no concern of the image bearers being damaged if the printing medium-conveyance unit is separated from the image bearers. However, this method entails a time loss. Therefore, since the phase of the rotational stop-position (which means the start-position for rotation) of each image bearer is shifted as above, it is possible to realize the driving method described in the first aspect in a simple manner.

According to the invention defined by the fourth aspect, each image bearer is stopped at a position after a lapse of a period of time containing a predetermined margin period of time, instead of stopping it immediately after the detection of the reference mark. Therefore, the predetermined stop-state can be realized in a marginally minimized time (with a marginally minimized rotary angle).

In the above case, suppose that no margin period of time is reserved, if the amount of correction for a certain image bearer with respect to the reference image bearer is positive, the image bearer may be stopped after an extra rotation corresponding to the amount of correction. However, when the amount of correction is negative, the image bearer goes beyond the position to be stopped. So to stop the image bearer at the correct position, the image bearer need to be rotated one more revolution. As already stated, in the conventional configuration, all the image bearers are started to rotate at the same time and stopped at the same time while the printing medium-conveyance unit is continuously (other than the jammed paper removal) put in proximity to the image bearers, so that such a large rotation will produce marked damage to the surfaces of the image bearers. Thus, the above configuration is able to set the apparatus into the stand-by state which enables an ideal recording of an image, in a short period while suppressing damage to the surface of each image bearer, making it possible to perform smooth recording of a subsequent image.

According to the invention defined by the fifth aspect, use of a simple configuration positively enables each image bearer to be stopped in a suitable state.

According to the invention defined by the sixth aspect, the positional relationship between the adjoining transfer stations can be corrected by adjusting the stop-position of the image bearer facing the transfer station downstream. Similarly, even if the positional relationship between the detectors for detecting the reference marks is disordered, it is possible to adjust and correct the stop-position of the image bearer for which the detector is displaced, in a similar manner.

According to the invention defined by the seventh aspect, if there occurs a factor that varies the stop-position of the image bearer in each recording portion, the image bearer in each recording portion is controlled so as to be stopped at the predetermined stop-position. Therefore, the image bearer in each recording portion is stopped and set in the appropriate stop-position before the recording of an image is started so that for subsequent operations the image of each component color can be exactly superimposed over the others without being affected by periodic, driving unevenness, thus making it possible to reproduce a correct color image.

According to the invention defined by the eighth aspect, the image bearer in each recording portion is controlled so as to be stopped at the predetermined stop-position when the power to the apparatus is activated. Therefore, the image bearer in each recording portion is always stopped and set in the appropriate stop-position before recording of an image is permitted so that for subsequent operations the image of each component color can be exactly superimposed over the others without being affected by periodic, driving unevenness, thus making it possible to reproduce a correct color image. Further, the apparatus can start recording of an image in a suitable condition as soon as it becomes prepared for recording.

According to the invention defined by the ninth aspect, the image bearer in each recording portion is controlled so as to be stopped at the predetermined stop-position after the periodic check (after parts replacement, unit adjustment, etc.). Therefore, whenever the periodic check such as parts replacement, unit adjustment or the like, which is highly likely to cause variations in the stop-positions, has been done, the image bearer in each recording portion is stopped and set in the appropriate stop-position so that for subsequent operations the image of each component color can be exactly superimposed over the others without being affected by periodic, driving unevenness, thus making it possible to reproduce a correct color image. Further, the apparatus can start recording of an image in a suitable condition as soon as it becomes prepared for recording.

According to the invention defined by the tenth aspect, the image bearer in each recording portion is controlled so as to be stopped at the predetermined stop-position after removal of abnormally fed printing medium. Therefore, it is possible to configure the driving mechanism so as to be temporarily released to facilitate easy removal of the printing medium that caused paper jamming, from the conveyance path without giving damage to the image bearer surfaces, and after the removal, the image bearer in each recording portion is always stopped and set in the appropriate stop-position so that for subsequent operations the image of each component color can be exactly superimposed over the others without being affected by periodic, driving unevenness, thus making it possible to reproduce a correct color image.

According to the invention defined by the eleventh aspect, the image bearer in each recording portion is controlled so as to be stopped at the predetermined stop-position after the release of the printing medium-conveyance unit. Therefore it is possible to provide a configuration which permits easy removal of the printing medium that caused paper jamming from the conveyance path, and after the removal, the image bearer in each recording portion is always stopped and set in the appropriate stop-position so that for subsequent operations the image of each component color can be exactly superimposed over the others without being affected by periodic, driving unevenness, thus making it possible to reproduce a correct color image.

According to the invention defined by the twelfth aspect, the image bearer in each recording portion is controlled so as to be stopped at the predetermined stop-position every predetermined times of image recording. Therefore it is possible to minimize (correct) the misregistration, due to periodic driving unevenness of the image bearer in each recording portion, increasing as recording proceeds. As a result, the image of each component color can be exactly superimposed over the others without being affected by periodic, driving unevenness, thus making it possible to reproduce a correct color image.

According to the invention defined by the thirteenth aspect, the image bearer in each recording portion is controlled so as to be stopped at the predetermined stop-position after image formation has been performed with at least one of a plurality of recording portions stopped. Therefore, after image recording using part of a plurality of recording portions, the image bearer in each recording portion is stopped and set in the predetermined stop-position so that for subsequent operations the image of each color developer can be exactly superimposed over the others without being affected by periodic, driving unevenness, thus making it possible to reproduce a correct color image.

According to the invention defined by the fourteenth aspect, the image bearer in each recording portion is controlled so as to be stopped at the predetermined stop-position after image formation of black developer has been performed. Therefore, after image recording using part (the black image recording portion) of the multiple recording portions, the image bearer in each recording portion is stopped and set in the predetermined stop-position so that for subsequent operations the image of each color developer can be exactly superimposed over the others without being affected by periodic, driving unevenness, thus making it possible to reproduce a correct color image.

According to the invention defined by the fifteenth aspect, since the printing medium-conveyance unit is retracted from the image bearers in the recording portions when the image bearer in each recording portion is controlled to stop at the predetermined stop-position, the printing medium-conveyance unit is separated from the image bearer surfaces so as to minimize the load acting on the image bearer surface of each recording portion, thus making it possible to make sure the stop-position of each image bearer. This configuration also contributes to prevention of damage (scratching) to the image bearer surfaces.

According to the invention defined by the sixteenth aspect, since regardless of monochrome copy or color copy, the abutment position on the surface of the image bearer against the printing medium-conveyance unit when the image bearer starts rotating differs from the abutment position when the image bearer stops rotating, rubbing of the surface of the image bearer with the printing medium-conveyance unit arising due to the time lag at the start or stop of driving will not concentrate at one point. Thus, damage to the image bearer surface due to its contact with the printing medium-conveyance unit will not concentrate at a local area. Therefore, it is possible to prevent marked, local performance degradation of the image bearer.

Further, since the first abutment position and the second abutment position are set different when the image bearer is rotated, it is possible to efficiently change the abutment position.

According to the invention of the seventeenth aspect, each image bearer is rotated with its driving unevenness shifted out of phase from the others so that periodic, rotational driving unevenness of each image bearer produces the same variation with respect to the printing medium passing through the successive transfer stations. Therefore, the images formed on different image bearers can be sequentially superimposed under the same condition without having any influence of periodic driving unevenness of the image bearers. Hence, the final output image can be reproduced correctly without color misregistration.

Since the abutment position on the surface of the image bearer against the printing medium-conveyance unit when the image bearer starts rotating differs from the abutment position when the image bearer stops rotating, rubbing of the surface of the image bearer with the printing medium-conveyance unit arising due to the time lag at the start or stop of driving will not concentrate at one point. Thus, damage to the image bearer surface due to its contact with the printing medium-conveyance unit will not concentrate at a local area. Hence, it is possible to prevent marked, local performance degradation of the image bearer.

Further, since the first abutment position and the second abutment position are set different when the image bearer is rotated, it is possible to efficiently change the abutment position.

According to the invention of the eighteenth aspect, among all the image bearers in the multiple recording portions arranged in series in the conveyed direction of the printing medium, the stop-position of the image bearer which is likely to be most severely degraded is varied while the rest image bearers are stopped with their rotational driving unevenness shifted from each other in the predetermined relationship. Therefore, the stop-positions of the rest image bearers are corrected in conformity with the image bearer having the most intensively degraded due to the difference of the image forming mode. Thus, damage to the image bearer exposed to the most harsh conditions can be made uniform by preventing it from being alone degraded too much. Accordingly, since each image bearer is degraded on the average, it is possible to reduce the number of maintenance.

According to the invention of the nineteenth aspect, the first and second abutment positions are altered every predetermined number of stops or starts of driving of the multiple image bearers. Therefore, it is possible to efficiently prevent damage to the image bear surfaces by selecting the predetermined number in its various usage conditions.

According to the invention of the twentieth aspect, since regardless of monochrome copy or color copy, the abutment position on the surface of the image bearer against the printing medium-conveyance unit can be altered every time the predetermined number of stops or starts of driving of the image bearer is reached, rubbing of the surfaces of the image bearer and the printing medium-conveyance unit arising due to the time lag at the start or stop of driving will not concentrate at local areas. Thus, damage to the image bearer surface due to its contact with the printing medium-conveyance unit will not concentrate at one point. Hence, it is possible to prevent marked, local performance degradation of the image bearer.

According to the invention defined by the twenty-first aspect, since both the first control means for controlling the image forming process and the second control means for controlling the stop-position of the image bearer are configured to perform their control based on the common sensor detecting the reference mark, the cost can be reduced without the need to provide a dedicated sensor for each. Further, since the image bearer is stopped at the predetermined position by directly detecting the reference mark which rotates in harmony with the rotation of the rotationally driven image bearer, it is possible to precisely stop the rotation of image bearer with the desired relationship taking into account driving unevenness as well as damage to the image bearer, etc.

According to the invention defined by the twenty-second aspect, since the reference mark which is attached on the surface of the rotationally driven image bearer is directly detected so as to stop the image bearer at the predetermined position, it is possible to precisely stop the image bearer every time, with the desired relationship.

According to the invention defined by the twenty-third aspect, since the reference mark is coated by the se photoconductive layer, it is less damaged. Since the position of attachment is not limited, it is possible to enhance the flexibility of the position of attachment of the sensor.

According to the invention defined by the twenty-fourth .aspect, since the reference mark which is attached on a drive transmission member for transmitting a rotational driving force to the image bearer is directly detected so as to stop the image bearer at the predetermined position, it is possible to precisely stop the image bearer every time, with the desired relationship.

According to the invention defined by the twenty-fifth aspect, since the stop-position of the image bearer is altered periodically every predetermined number of copiers and/or after a lapses of a predetermined period of time, the position of the image bearer in contact with other parts is changed periodically so that it is possible to prevent the image bearer surface from being damaged locally, and hence lengthen the life of the image bearer.

According to the invention defined by the twenty-sixth aspect, since the image bearer is supported in the predetermined relationship with respect to the driving mechanism and hence the behavior of periodic rotational driving unevenness of the rotationally driven image bearer will fall within the expected range, it is possible to take reliable countermeasures against the rotational driving unevenness.

According to the invention defined by the twenty-seventh aspect, it is possible to check whether the image bearer is supported in the predetermined relationship with the driving mechanism, while for subsequent operations the stop-position of the image bearer can be controlled keeping the predetermined relationship.

According to the invention defined by the twenty-eighth aspect, when designated image bearers are set with the predetermined positional relationship, the image bearers can be precisely stopped in the predetermined relationship. If the image bearers are attached in a wrong manner or a wrong image bearer other than that designated is placed, the image reproduction is continued to output an image whatever it image instead of completely stopping the machine, so as not to offend the user.

DESCRIPTION OF THE PREFERRED EMBODIMENTS

Figure 2:
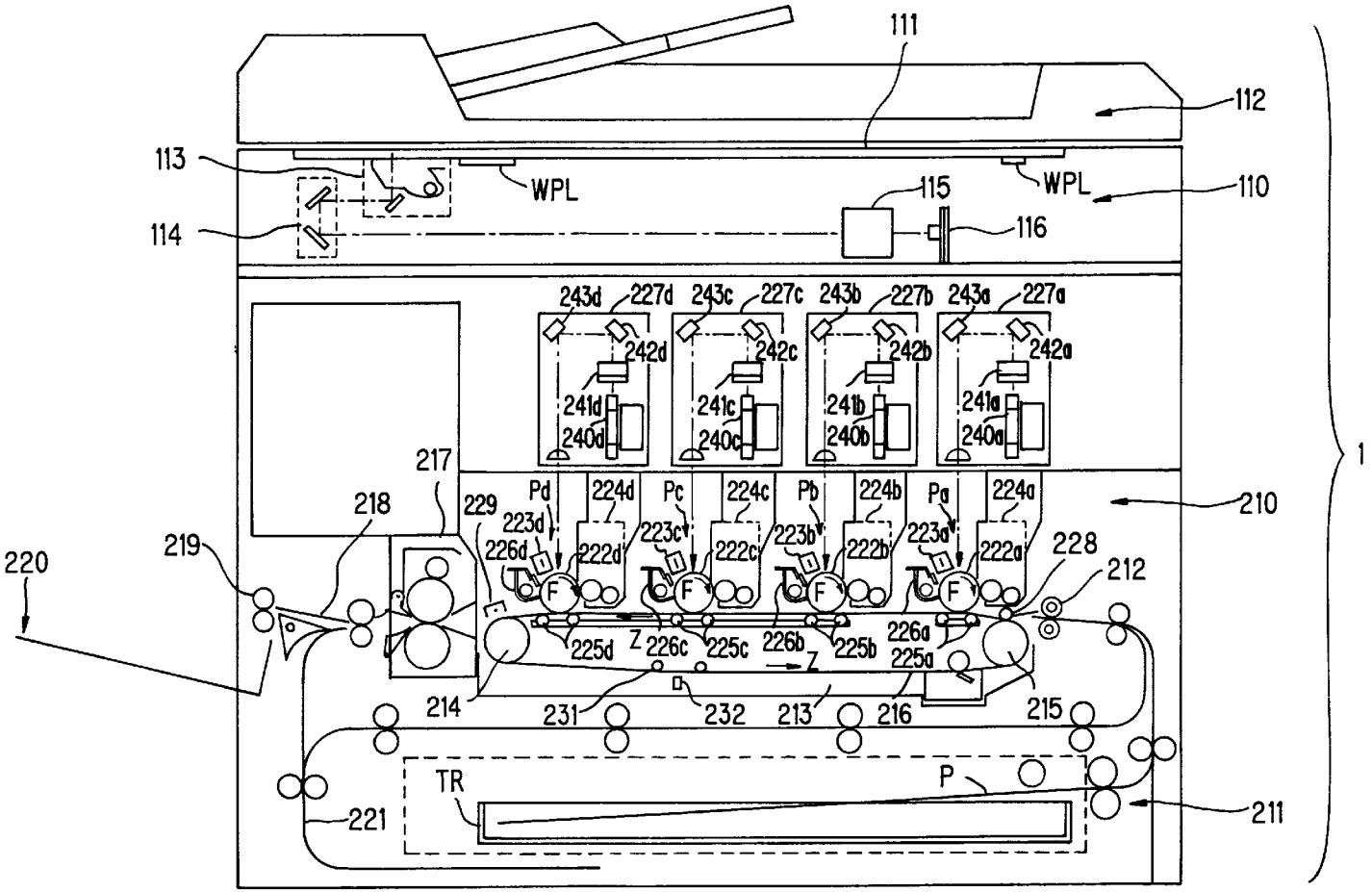
FIG. 2 is a front sectional view showing a digital color copier 1 in accordance with the embodiment of the invention.

The embodiments of the invention will hereinafter be described in detail with reference to the accompanying drawings. One embodiment of the invention will be described hereinbelow with reference to FIGS. 2 through 13. FIG. 2 is an overall front sectional view showing a configuration of a digital color copier 1 as an image forming apparatus of the embodiment of the invention. Copier body 1 has an original table 111 and an unillustrated control panel on the top thereof and has an image reading portion 110 and an image forming portion 210 within. A reversing automatic document feeder (RADF) 112 is arranged on the top surface of original table 111 in the predetermined position with resect to the original table 111 surface, whilst being supported so as to be opened and closed relative to original table 111.

RADF 112, first, conveys an original so that the one side of the original opposes image reading portion 110 at the predetermined position on original table 111. After the image scanning of this side is completed, the original is inverted and conveyed to original table 111 so that the other side opposes image reading portion 110 at the predetermined position on original table 111. Then, when RADF 112 completes image scanning of both sides of one original, the original is discharged and the duplex copy conveying operation for a next document is effected.

The above operation of the conveyance and face inversion of the original is controlled in association with the whole operation of copier 1.

Image reading portion 110 is disposed below original table 111 in order to read the image of the original conveyed onto original table 111 by the RADF112. Image reading portion 110 includes original scanning portion 113 and 114 which reciprocates along, and in parallel to, the undersurface of original table 111, an optical lens 115 and a CCD line sensor 116 as a photoelectric converting device.

This original scanning portion 113 and 114 is composed of first and second scanner units 113 and 114. First scanner unit 113 has an exposure lamp for illuminating the original image surface and a first mirror for deflecting the reflection image of light from the original in the predetermined direction and moves in a reciprocating manner in parallel with, whilst being kept a certain distance away from, the undersurface of original table 111 at the predetermined speed.

Second scanner unit 114 has second and third mirrors which deflect the reflected light image from the original, deflected by first mirror of first scanner unit 113, in the predetermined direction and moves in a reciprocating manner at a speed related to that of first scanner unit 113 and in parallel thereto.

Optical lens 115 reduces the reflected light image from the original, thus deflected by third mirror of the second scanner unit, so that the reduced light image will be focused on the predetermined position on CCD line sensor 116.

CCD line sensor 116 photoelectrically converts the focused light image, line by line, into an electric signal and outputs it. CCD line sensor 116 is a three-line color CCD which can read monochrome and color images and output line data as to color separation components R(red), G(green) and B(blue). The original image information thus obtained as the electric signal from this CCD line sensor 116 is further transferred to an unillustrated image processor where the predetermined image data processes are performed.

Next, the configuration of recording portion 210 and the configuration of the portions related to recording portion 210 will be described.

Provided below recording portion 210 is a paper feeding mechanism 211 which separates a sheet (e.g.,paper, OHP sheet, or other printing medium) P, one by one, from a stack held in a paper feed tray TR and feeds it toward image forming portion 210. The sheet P thus separated and fed one by one is delivered into image forming portion 210 with its timing controlled by a pair of registration rollers 212 located before image forming portion 210. The sheet P with an image formed on its one side is conveyed and re-fed to image forming portion 210 in time with image forming of image forming portion 210.

Arranged under image forming portion 210 is a conveyer and transfer belt mechanism 213. Conveyer and transfer belt mechanism 213 is composed of a driving roller 214, an idle roller 215 and a conveyer and transfer belt 216 wound and tensioned in parallel between the two rollers so as to convey sheet P being electrostatically attracted to the belt. Further, a pattern image detecting unit 232 is provided under and in proximity to the circulating track of conveyer and transfer belt 216. Pattern image detecting unit 232 detects and recognizes the test pattern formed on conveyer and transfer belt 216 by means of an unillustrated sensor and adjusts the image forming positions of the image forming portion based on the detected result. Here, the means for conveying sheet P is not limited to the aforementioned conveyer and transfer belt 216. That is, the means may be any one which can cause the toner image to transfer from the aftermentioned photosensitive drums to sheet P: for example, rollers or other conveying means may be used.

Arranged in the paper conveyance path, downstream of conveyer and transfer belt mechanism 213 and in proximity to driving roller 214 is a fixing unit 217 for fixing the toner image transferred on sheet P onto sheet P. Sheet P having passed through the nip between a pair of fixing rollers of fixing unit 217 passes through a conveyance direction switching gate 218 and is discharged by discharge rollers 219 to a paper output tray 220 attached to the outer wall of copier body 1.

Switching gate 218 selectively connects the conveyance path of sheet P after fixing with either the path to discharge sheet P to the outside of copier body 1 or the path to recirculate sheet P toward image forming portion 210. The sheet P which is designated to be conveyed again to image forming portion 210 by means of switching gate 218 is inverted by means of a switch-back conveyance path 221 and then re-fed to image forming portion 210.

Arranged above, and in proximity to, conveyer and transfer belt 216 in image forming portion 210 are the first image forming station Pa, the second image forming station Pb, the third image forming station Pc and the fourth image forming station Pd, in the above mentioned order from the upstream side of the paper conveyance path.

Figure 1:
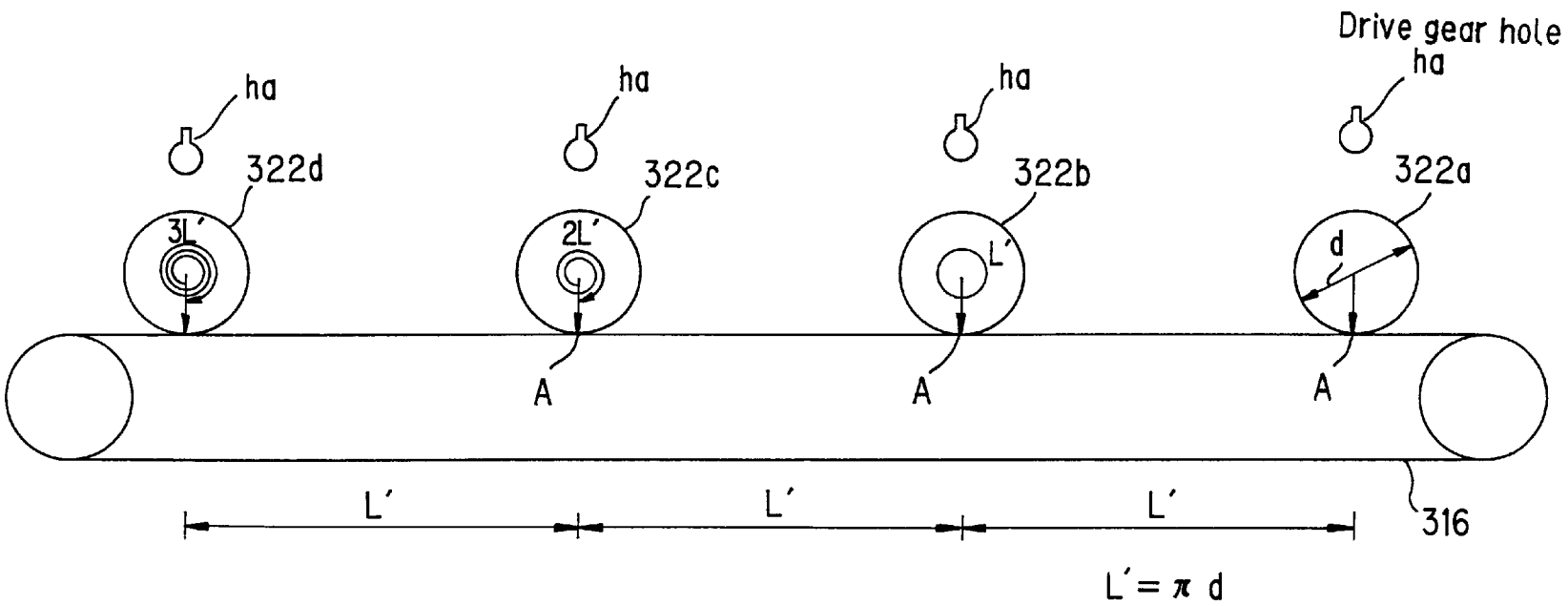
FIG. 1 PRIOR ART
FIG. 1 is an illustrative view showing the positional relationship between the photosensitive drums and the conveyer and transfer belt in a conventional configuration.

Conveyer and transfer roller 216 is frictionally driven by driving roller 214 in the direction indicated by arrow Z in FIG. 1, and carries sheet P which is fed by paper feeding mechanism 211 as stated above and sequentially conveys it to image forming stations Pa to Pd.

All the image forming stations Pa to Pd are substantially identical configuration. Each image forming station Pa, Pb, Pc and Pd has a photosensitive drum 222*a*, 222*b*, 222*c* and 222*d*, which is driven in the rotational direction indicated by arrow F in FIG. 1.

Provided around each photosensitive drum 222*a* to 222*d*, are a primary charger 223*a*, 223*b*, 223*c* and 223*d* for uniformly charging photosensitive drum 222*a*, 222*b*, 222*c* and 222*d*, a developing unit 224*a*, 224*b*, 224*c* and 224*d* for developing the static latent image formed on photosensitive drum 222*a*, 222*b*, 222*c* and 222*d*, a transfer charger 225*a*, 225*b*, 225*c* and 225*d* for transferring the developed toner image (developer image) on the photosensitive drum to sheet P, and a cleaning unit 226*a*, 226*b*, 226*c* and 226*d* for removing the leftover toner from the photosensitive drum, in this order with respect to the rotational direction of photosensitive drum 222*a*, 222*b*, 222*c* and 222*d*.

Arranged above photosensitive drums 222*a* to 222*d* are laser beam scanner units 227*a*, 227*b*, 227*c* and 227*d*, respectively.

Each laser beam scanner unit 227*a* to 227*d* includes: a semiconductor laser element (not shown) for emitting a spot beam modulated in accordance with the image data; a polygon mirror (deflecting device) 240 for deflecting the laser beam from the semiconductor laser element, in the main scan direction; an f-theta lens 241 for focusing the laser beam deflected by polygon mirror 240 onto the surface of photosensitive drum 222*a* to 222*d*; and mirrors 242 and 243.

The pixel signal corresponding to the black component (Bk) image of a color original image is supplied to laser beam scanner unit 227*a*; the pixel signal corresponding to the cyan (C) color component image of a color original image is supplied to laser beam scanner unit 227*b*; the pixel signal corresponding to the magenta (M) color component image of a color original image is supplied to laser beam scanner unit 227*c*; and the pixel signal corresponding to the yellow (Y) color component image of a color original image is supplied to laser beam scanner unit 227*d*.

In this arrangement, the static latent images corresponding to the color separations of the original image information are formed on photosensitive drums 222*a* to 222*d*, respectively. Developing units 224*a*, 224*b*, 224*c* and 224*d* hold black (Bk) toner (developer), cyan (C) color toner (developer), magenta (M) color toner (developer), yellow (Y) color toner (developer), respectively. The static latent image on photosensitive drum 222*a* to 222*d* is developed by the toner of a corresponding color. Thus, the color separations of the original image information are reproduced as toner images by image forming portion 210.

Provided between the first image forming station Pa and paper feeding mechanism 211 is a paper-attraction (brush) charger 228, which electrifies the conveyer and transfer belt 216 surface so that sheet P fed from paper feeding mechanism 211 is conveyed without any slip or slide, whilst being reliably attracted to conveyer and transfer belt 216, from the first image forming station Pa to the fourth image forming station Pd.

An erasing device (not shown) is arranged approximately directly above driving roller 214 located between the fourth image forming station Pd and fixing roller 217. Applied to this erasing device is an alternating current for separating sheet P electrostatically attracted to conveyer and transfer belt 216, from the belt.

In the thus configured digital color copier, cut-sheet type paper is used as sheet P. When sheet P is delivered from the paper feed cassette into the guide of the paper conveyance path of paper feeding mechanism 211, the leading edge of sheet P is detected by a sensor (not shown), which outputs a detection signal, based on which a pair of registration rollers 212 briefly stops the paper. Then, sheet P is delivered in synchronization with image forming stations Pa to Pd, onto conveyer and transfer belt 216 rotating in the direction of arrow z in FIG. 1. Meanwhile, conveyer and transfer belt 216 has been charged in a predetermined manner by paper-attraction charger 228 as stated above, so that sheet P is stably fed and conveyed throughout the passage of all the image forming stations Pa to Pd.

In each image forming station Pa to Pd, the toner image of each color is formed so that the different color images are superimposed on the support surface of sheet P which is conveyed whilst being electrostatically attracted by conveyer and transfer belt 216. When transfer of the image formed by the fourth image forming station Pd is completed, sheet P is separated by virtue of the erasing device, continuously starting at its leading edge, from conveyer and transfer belt 216 and introduced into fixing unit 217. Finally, sheet P having the toner image fixed thereon is discharged through the paper discharge port (not shown) onto paper output tray 220.

In the above description, writing to the photosensitive drum is performed by laser beam scanning exposure using laser beam scanner units 227*a* to 227*d*. However, instead of the laser beam scanner units, another type of optical writing system made up of light emitting diodes with a focusing lens array (LED head) may be used. The LED head is smaller in size compared to laser beam scanner unit and has no moving parts hence is silent. Therefore, this LED head can be preferably used for image forming apparatuses such as digital color copiers of a tandem arrangement type which needs multiple optical writing units.

Figure 3:
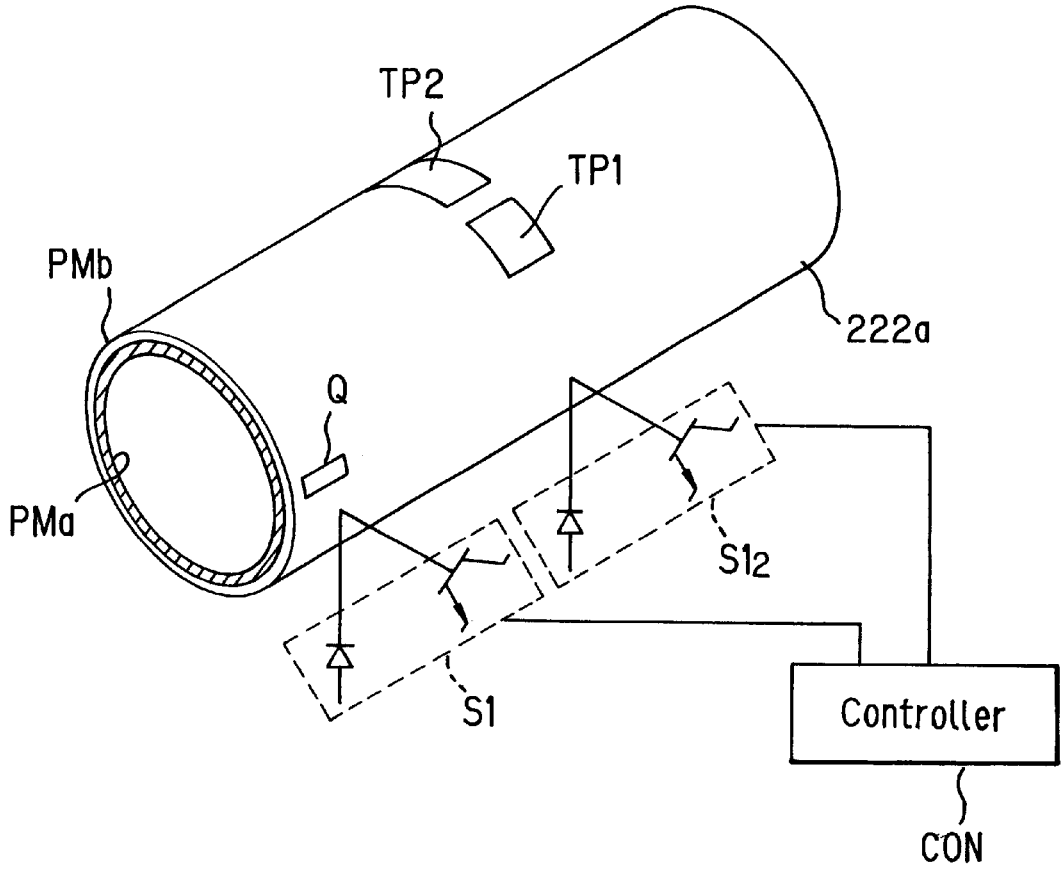
FIG. 3 is a perspective view showing a photosensitive drum in accordance with the embodiment of the invention.

Referring next to FIGS. 2 and 3, the toner image density forming process of each color image formed on the photosensitive drum in each image forming station Pa-Pd will be explained taking an example of image forming station Pa.

First, when the power is applied to digital color copier 1, photosensitive drum 222*a* starts rotating, and a sensor S1 detects a reference mark Q in FIG. 3. This detection produces a signal synchronized with the rotation of photosensitive drum 222*a*, so that a toner pattern of some centimeters by some centimeters is formed on the photosensitive drum 222*a* surface based on this signal. This toner pattern TP1 is formed by forming a static latent image of a standard white plate WPL (see FIG. 2) on the photosensitive drum 222*a* surface and developing it into a toner image through developing unit 224*a*. The process parameters are set so that the density of toner pattern TP1 will be equal to a reference density, for example, 1.0. In this case, the process parameters may be more exactly set by forming multiple toner patterns (TP1 and TP2) and making control so as to change the density of each toner pattern.

The density values of the thus formed toner patterns TP1 and TP2 and the density values of non-image areas around the toner patterns are detected by an optical sensor $S1_2$ and the detected signals are sent to a controller CON so that the density ratio is determined. Based on the result, the image forming process parameters of image forming station Pa are corrected.

When multiple toner patterns are used, the variation of each toner pattern from the set density can be checked, so that it is possible to know the direction of correction of the image forming process parameters (for example, the direction of correction such as whether the density should be controlled so as to be higher or lower) and hence make a more exact correction. Photosensitive drum 222*a* is formed of a cylindrical conductive support member PMa and a photoconductive layer PMb having a predetermined thickness coated on the cylindrical conductive support member PMa.

For conductive support member PMa, aluminum, aluminum alloy, copper, zinc, stainless steel, vanadium, chromium, titanium, nickel, molybdenum, indium, gold, platinum, etc. can be used. Other than these, it is possible to use a plastic (for example, polyethylene, poly-divinyl oxide, polypropyrene, poly vinyl chloride, polyethylene terephthalate, acrylic resin, polyfluoroethylene, etc.) having a coating formed of aluminum, aluminum alloy, indium oxide, tin oxide or indium oxide-tin oxide alloy, by vacuum deposition.

For the material of photoconductive layer PMb, selenium, selenium alloy, amorphous silicon, organic semiconductive and photoconductive substances and the like can be used.

As to the arrangement of reference mark Q, when an OPC photosensitive drum or the like is used, the mark should be arranged in the non-transfer area at the side part of the photosensitive drum on the photoconductive layer PMb surface of photosensitive drum 222*a* as shown in FIG. 3; otherwise the reference mark Q would appear in the image. Further, in order to prevent its abrasion and breakage, the mark is preferably arranged at a position so as not to interfere with cleaning unit 226*a*.

Figure 4A:
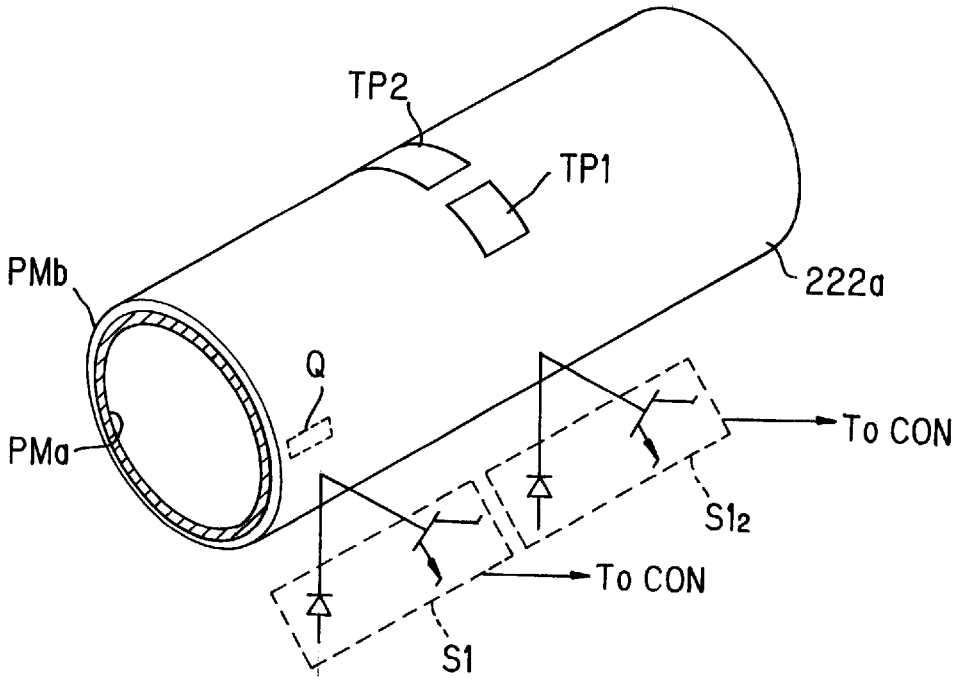
FIGS. 4A and 4B are perspective views showing a photosensitive drum in accordance with the embodiment of the invention.
Figure 4B:
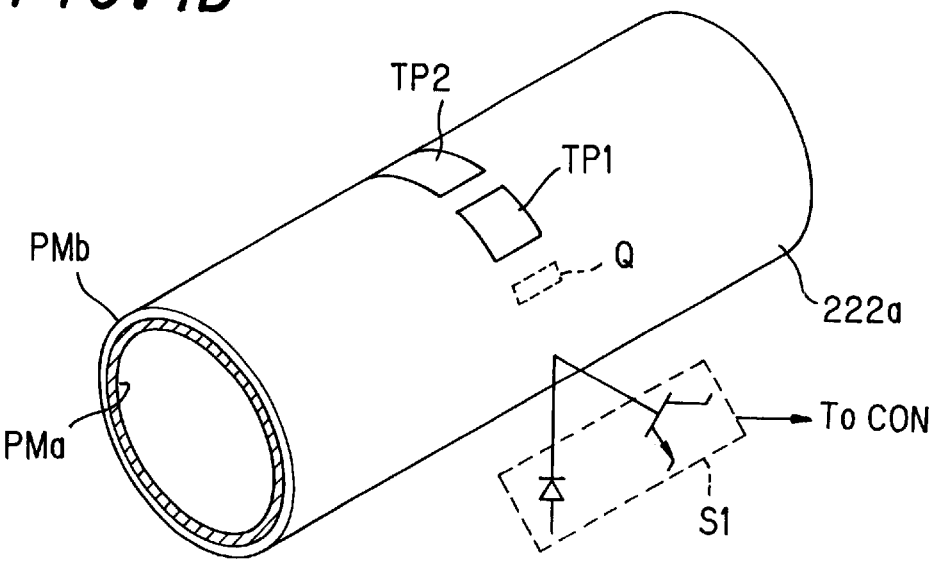

In contrast, when a selenium type photosensitive drum which will not cause reference mark Q to appear in the image is used, the mark may be formed on conductive support member PMa and then coated by photoconductive layer PMb, as shown in FIGS. 4A and 4B. In this case, wear of reference mark Q can be prevented and its position with respect to the longitudinal direction of the photosensitive drum is not limited (it may be formed in the middle of the length of the photosensitive drum (FIG. 4A) or it may be formed at the edge part thereof (FIG. 4B)).

Reference mark Q has a function of enabling detection of the rotation of photosensitive drum 222*a* and issuing a photosensitive drum's rotation synchronizing signal to controller CON. Therefore, instead of its provision on the photosensitive surface of the photosensitive drum, the mark may be attached to, for example, a driving gear G for transmitting the driving force to the shaft of photosensitive drum 222*a*. Alternatively, as shown in FIG. 1, the keyhole-shaped hole ha of the engaging portion between driving gear G and the shaft may be detected by a sensor.

Next, a driving unevenness suppressing means in this embodiment will be described.

Figure 5:
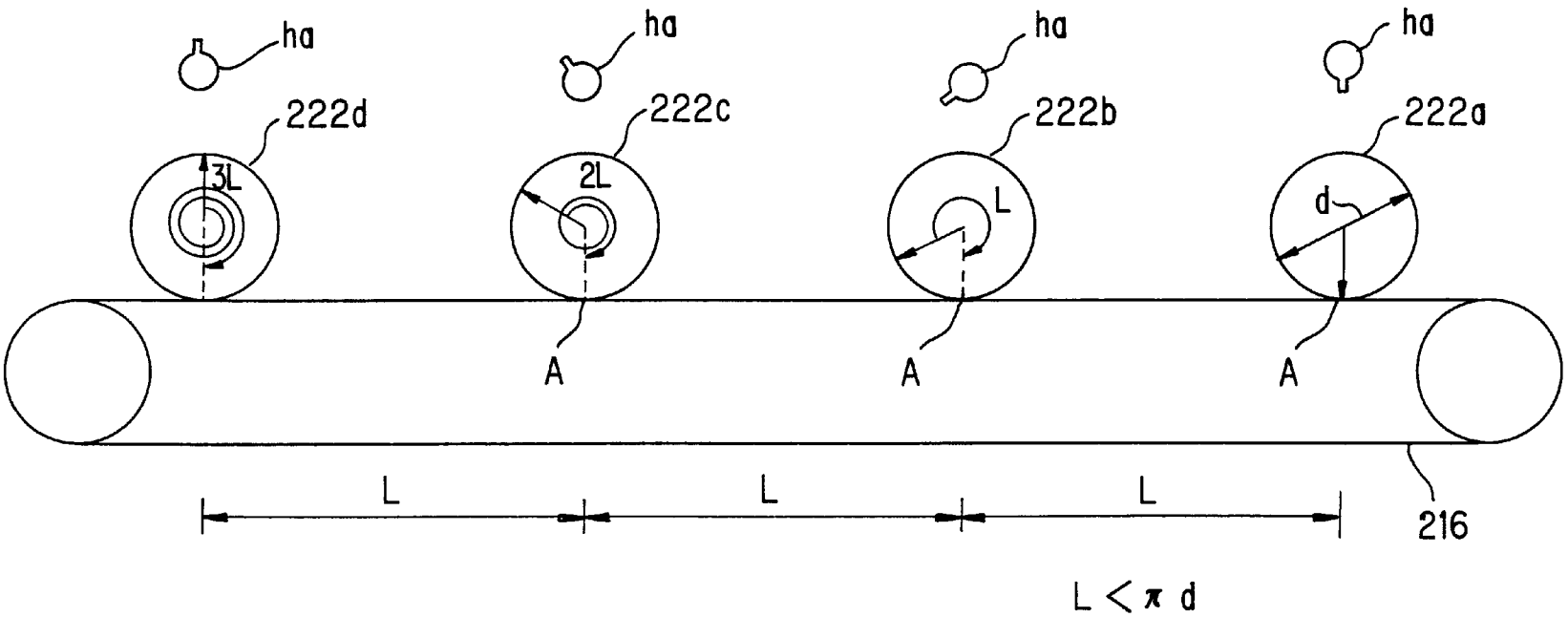
FIG. 5 is an illustrative view showing the positional relationship between the photosensitive drums and the conveyer and transfer belt in accordance with the embodiment of the invention.

In digital color copier 1 of this embodiment, as shown in FIG. 5, differing from the conventional configuration of the image forming apparatus shown in FIG. 1, four photosensitive drums 222*a* to 222*d* of image forming stations Pa to Pd (see FIG. 2) are arranged and rotated with the phase of the rotational driving unevenness of each photosensitive drum 222*a* to 222*d* (the variations of the driving unevenness are common for all the photosensitive drums if they are in phase) shifted from that of the others by the predetermined amount. Specifically, since all the photosensitive drums 222*a* to 222*d* start and stop rotating simultaneously, the drums are stopped with their stop-positions (rotation start-positions) shifted from one another at their initialization, setting a phase-shifted state. In FIG. 5, similarly to FIG. 1, setting of the phase shifts of photosensitive drums 222*a* to 222*d* is performed in reference to keyhole-shaped holes ha of the driving gears which are attached to the shafts of photosensitive drums 222*a* to 222*d* for driving power transmission.

Now, assuming photosensitive drum 222*a* for black (Bk) is the reference, the adjacent, photosensitive drum 222*b* of cyan (C) is stopped with a leading phase angle of about 60 deg. Similarly, photosensitive drum 222*c* of magenta (M) is stopped with a leading phase angle of 120 deg., and photosensitive drum 222*d* of yellow (Y) is stopped with a leading phase angle of 180 deg.

Phase shifting of the driving unevenness of each photosensitive drum from others in the above way makes it possible to coincide with the driving unevenness of each photosensitive drum to that of the others with respect to the printing medium passing through their transfer points, even if the distance between transfer areas A—A for image forming stations Pa to Pd is made shorter than the circumference of the photosensitive drums.

When the phase of the driving unevenness between adjacent photosensitive drums is shifted by 60 deg. in the above way, the distance L, corresponding to the interval between the adjacent transfer areas A—A is:

$$L=\pi d \text{ (circumference of the photosensitive drum)}\times(360-60)\text{ deg.}/360\text{ deg.}$$

where d is diameter of the photosensitive drum.

In the above, for description's convenience, the distance between adjacent transfer areas A—A was determined based on the difference in phase between the adjacent photosensitive drums. However, in practice, the distance L between the transfer areas A—A may be determined first and then the phase difference between photosensitive drums may be determined based on the distance. For example, when photosensitive drums having a drum diameter of 40 mm are arranged 105 mm apart from each other, the stop-positions of the photosensitive drums are set in the way as above so that the driving unevenness of each photosensitive drum is shifted about 60 deg. out of phase that of the adjacent drum.

Next, description will be made on the way the image of each photosensitive drum is superimposed one over another without color misregistration due to driving unevenness with reference to FIG. 6.

Figure 6:
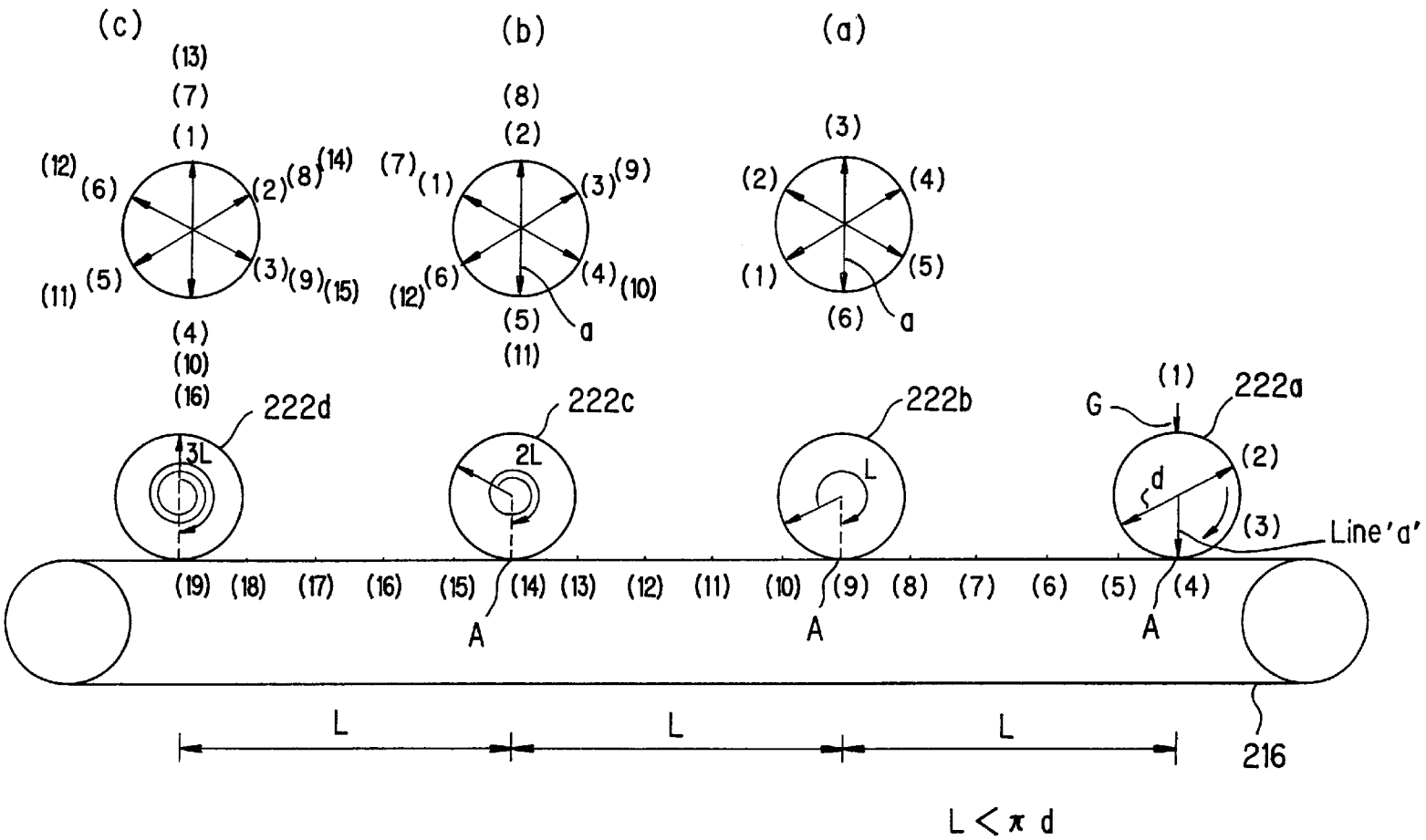
FIG. 6 is an illustrative view showing the relationship between the intervals of four photosensitive drums and the transferred image in accordance with the embodiment of the invention.

Now, it is assumed that the four photosensitive drums are rotating in the state shown in FIG. 6. The image written at time (1) at the position 'G' of photosensitive drum 222*a* for black (more clearly, the reference of the driving unevenness is indicated by an arrowhead line 'a'), is transferred to the sheet on the conveyer and transfer belt 216 at time (4) (after the lapse of time requiring a 180 rotation of photosensitive drum 222*a*), and the image then is superimposed with another image on photosensitive drum 222*b* for cyan, at time (9). Here, the image on photosensitive drum 222*b* for cyan has been formed beforehand at time (6) by the laser beam (see FIG. 2).

FIG. 6(*a*) shows the positions of line 'a' of photosensitive drum 222*b* for cyan at each of different time (1) to (6). Apparent from the figure, line 'a' of drum 222*b* at time (9) is located at the same phase with that of photosensitive drum 222*a* for black at time (4). Accordingly, the variations due to driving unevenness of the superimposed images coincide with each other so that no color misregistration due to driving unevenness will occur.

Similarly, the image formed by photosensitive drum 222*c* for magenta is laid over at time (14). Here, the image on photosensitive drum 222*c* for magenta has been formed beforehand at time (11). FIG. 6(*b*) shows the positions of line 'a' of photosensitive drum 222*c* for magenta at different time (1) to (11). Apparent from the figure, line 'a' of drum 222*c* at time (11) is located at the same phase with that of photosensitive drum 222*a* for black at time (1) and that of photosensitive drum 222*b* for cyan at time (6). Accordingly, the variations due to driving unevenness of the superimposed images coincide with each other so that no color misregistration due to driving unevenness will occur.

Similarly, the image formed by photosensitive drum 222*d* for yellow is laid over at time (19). Here, the image on photosensitive drum 222*d* for yellow has been formed beforehand at time (16). FIG. 6(*c*) shows the positions of line 'a' of photosensitive drum 222*d* for yellow at different time (1) to (16). Apparent from the figure, line 'a' of drum 222*d* at time (16) is located at the same phase with that of photosensitive drum 222*a* for black at time (1), that of photosensitive drum 222*b* for cyan at time (6) and that of photosensitive drum 222*c* for magenta at time (11). Accordingly, the variations due to driving unevenness of the superimposed images coincide with each other so that no color misregistration due to driving unevenness will occur.

The rotational driving and stop of the four photosensitive drums 222*a* to 222*d* are controlled by controller CON (see FIG. 7) based on the reference marks in order to synchronize the behavior of the driving unevenness of each photosensitive drum with that of the others. Hereinbelow, it is assumed that the aforementioned reference mark Q for generation of the synchronizing signal to be used for forming toner patterns TP1 and TP2 on the photosensitive drum surface shown in FIGS. 3 and 4A and 4B is used.

Figure 7:
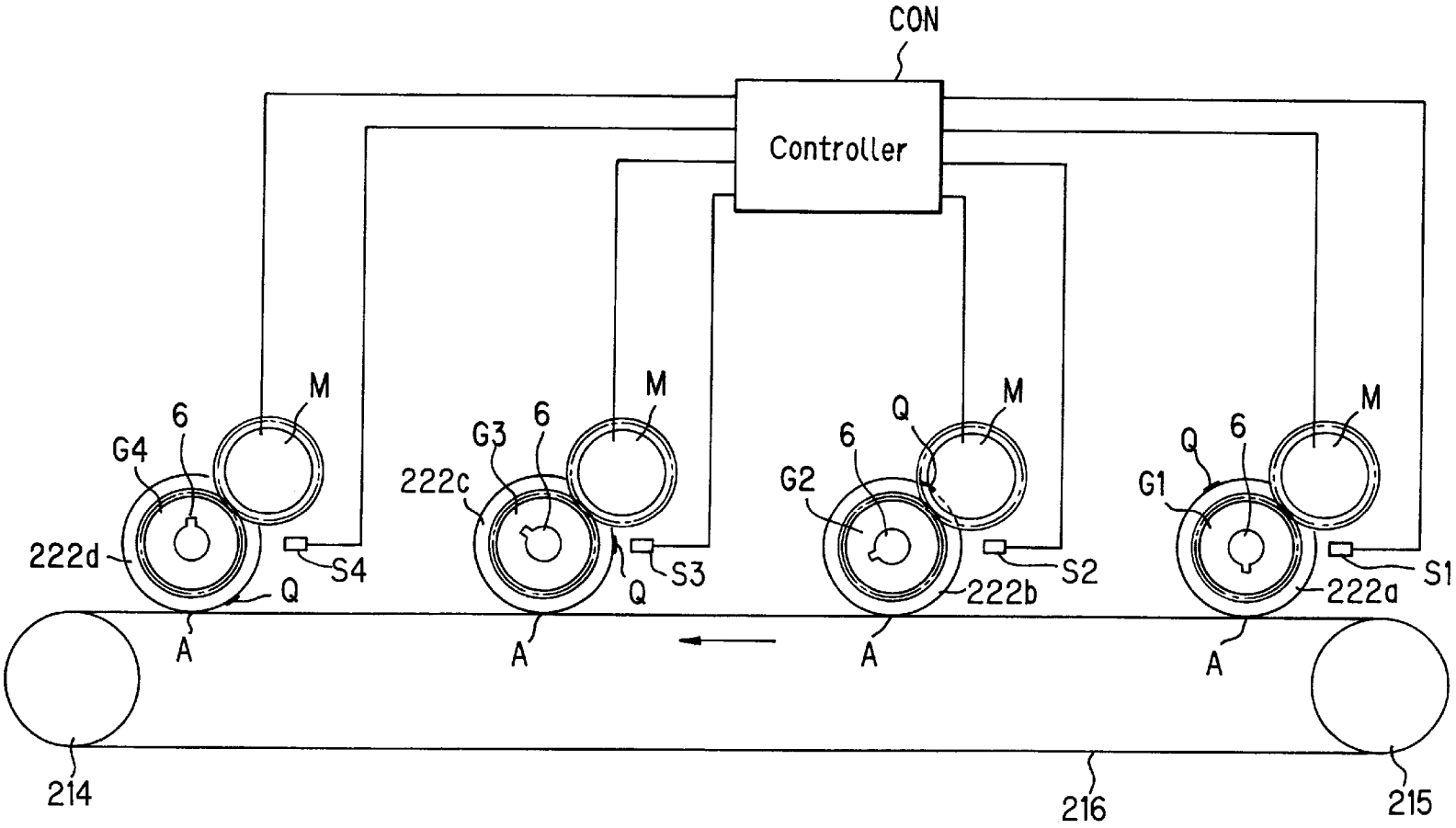
FIG. 7 is an illustrative view showing a control method of the photosensitive drums in accordance with the embodiment of the invention.
Figure 8:
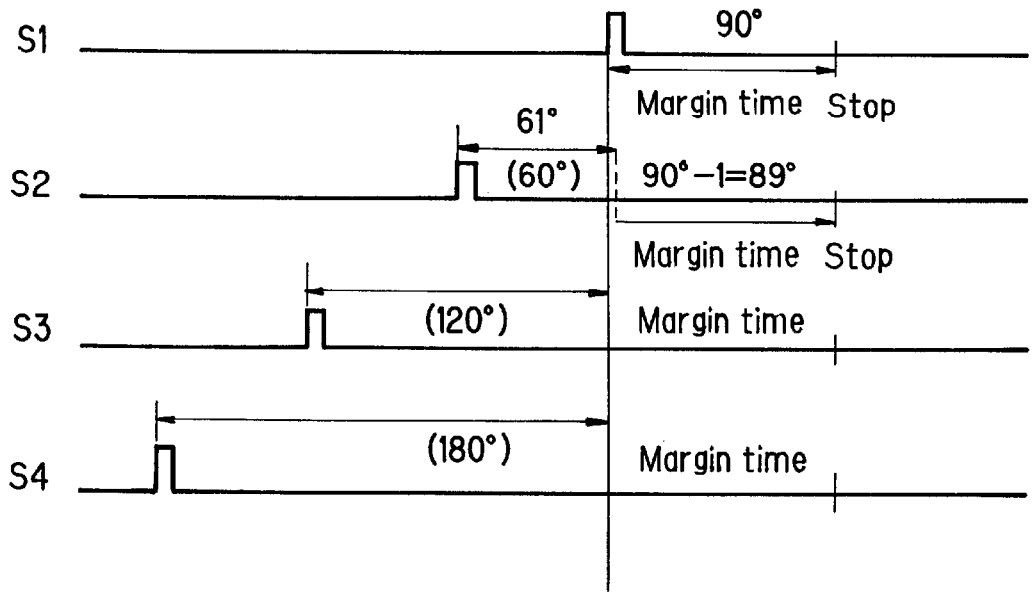
FIG. 8 is a time chart showing the drive and drive-stop timing of the four photosensitive drums in accordance with the embodiment of the invention.

Referring now to FIGS. 7 and 8, the rotational driving control of photosensitive drums 222*a* to 222*d* will be explained.

As shown in FIG. 7. since driving gears G1 to G4 for transmitting the rotational driving force to photosensitive drums 222*a* to 222*d* each have a keyhole-shaped mark (outward notch) where shafts 6 of the photosensitive drums fit to driving gears GI to G4, the pin provided on each shaft 6 is engaged with the outward notch. Therefore, all the shafts 6 are coupled with an individual driving mechanism of the same configuration so that all the shafts are rotated with a constant periodic driving unevenness characteristic.

Further, each image bearer (photosensitive drum) having reference mark Q on the photosensitive drum surface is supported on its rotationally driven shaft 6 in a predetermined positional relationship (set at the predetermined interval between adjacent photosensitive drums with its related phase shift therebetween), taking into account the variations of driving unevenness of the four photosensitive drums. Therefore, periodic variations of driving unevenness of all the photosensitive drums present almost the same behavior.

Rectangular reference marks Q on the drum surfaces are read by optical or other detection sensors S1 to S4. The detecting means should not be limited to this.

Each sensor S1 to S4 is arranged at an equivalent geometrical position with respect to its transfer area A. The detection output from each sensor is transferred to controller CON. Controller CON, based on the output, controls the rotation of each motor M for rotating its driving gear G1–G4 in order to rotate individual photosensitive drums, separately.

Controller CON, based on the detected results from sensors S1 to S4, exactly stops photosensitive drums 222*a* to 222*d* at their designated positions and starts rotating all the drums at the same time when a copying operation is started.

FIG. 8 shows the time relationship of the outputs from sensors S1 to S4 for stopping photosensitive drums 222*a* to 222*d*. The sensors are turned on as detecting reference mark Q: first, sensor S4 of photosensitive drum 222*d* located on the most downstream side and last, sensor S1 of photosensitive drum 222*a* located on the most upstream side.

The time from when the final sensor S1 is turned on until reference mark Q shown in FIG. 7 reaches transfer area A (here, a period of time required for a 90 deg. rotation) is assumed to be the margin period of time (margin angle), and after a lapse of the margin period of time, photosensitive drum 222*a* is stopped.

In photosensitive drums 222*b* to 222*d* other than the reference photosensitive drum 222*a*, based on the detected result from each sensor S2 to S4 and the detected result from sensor S1, the amount of correction to each drum is detected. This amount of correction is added to the margin period of time so that each drum is stopped when the set time has lapsed after when sensor S1 was turned on. In this way, each photosensitive drum can be set up with its phase exactly shifted by the designated amount.

For example, considering photosensitive drum 222*b* for cyan, photosensitive drum 222*b* should be shifted 60 deg. from photosensitive drum 222*a*. In this case, based on the time sensor S1 is turned on and the time sensor S2 is turned on, the amount of correction to photosensitive drum 222*b* is calculated. Here, if the difference is 61 deg., that is, the phase leads 1 deg. from the due phase, then one degree needs to be delayed. So the amount of correction is set at −1 and is added to 90 deg., which corresponds to the margin period of time. That is, the margin period of time (margin angle) is set at 89 deg., so that the drum is stopped when the margin period of time corresponding to 89 deg. has elapsed after sensor S1 was turned on.

In the above case, suppose that no margin period of time is reserved. Photosensitive drum 222*b* may be stopped after an extra rotation when the amount of correction is positive. However, when the amount of correction is negative, the drum goes beyond the correct position to be stopped. So to stop the drum at the correct position, the drum need to be rotated one more revolution. This would cause extra damage to conveyer and transfer belt 216 surface and the photosensitive drum surface. Thus, the above configuration is able to stop and set the drums at the state which enables an ideal recording of an image in a short period while inhibiting damage etc., making it possible to perform smooth recording of a subsequent image.

Even though the distance between transfer areas A—A is designed with the highest precision, the mounted positions of photosensitive drums 222*a* to 222*d* may be displaced with, for example, 100 $\mu$m error. This error will appear as a significant color misregistration in an image forming apparatus of high density recording such as 600 dpi (one dot size: about 43 $\mu$m). Therefore, it is preferable that a means which can adjust the stop-positions of the photosensitive drums, regardless of the driving unevenness of the photosensitive drums is also provided separately.

Similarly, the mounted positions of the above sensors S1 to S4 are also easily displaced, so it is preferable to have a configuration that can compensate for these errors. For example, in contrast to the above configuration where the margin period of times (margin angles) for all the four photosensitive drums are set at 90 deg, it is possible to set up the margin period of times that have been corrected beforehand in accordance with the mounting errors of the sensors and dimensional errors of the distance between transfer areas A—A, and add or subtract the amounts of correction to or from the corrected margin period of times.

Up to now, description has been made on the drive and drive-stop control method for driving the photosensitive drums in such a way that the phase of rotational driving unevenness of one drum from that of the adjacent one is shifted by the predetermined amount and stopping the photosensitive drums in such a way that the stop-position of each drum is shifted by the predetermined amount from that of the adjacent one.

Next, the factors causing the variation of the stop-position of each photosensitive drum at transfer area A will be discussed.

Conveyer and transfer belt mechanism 213 shown in FIG. 2 is configured so that its position can be switched between two positions, i.e., the sheet conveying position at which conveyer and transfer belt 216 is in close contact with image forming stations Pa to Pd so as to permit the conveyance of sheet P and the jammed sheet removal position at which conveyer and transfer belt 216 is positioned lower than the sheet conveying position, being kept away from image forming stations Pa to Pd.

Figure 9A:
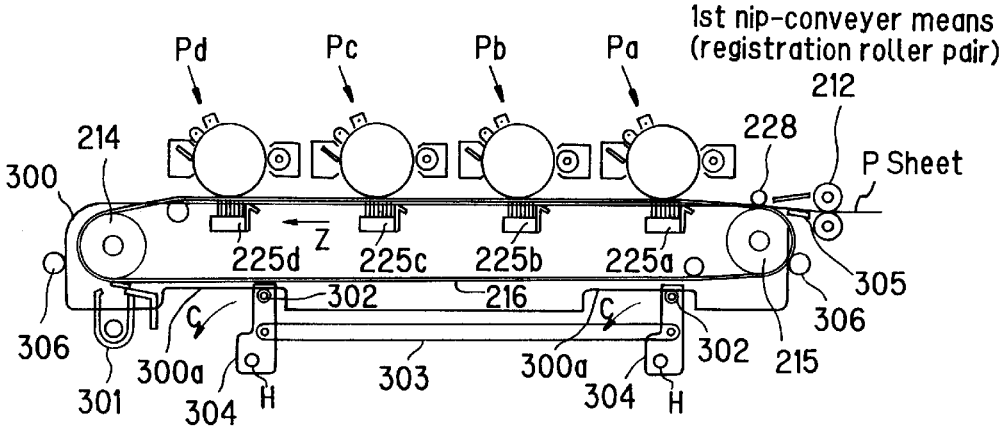
FIGS. 9A and 9B are illustrative views showing the contact and separated states of the conveyer and transfer unit.
Figure 9B:
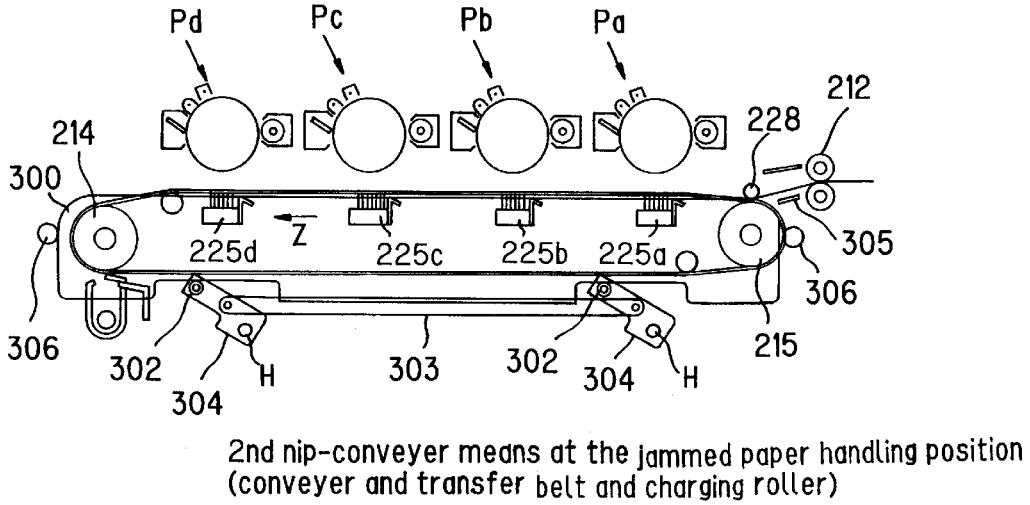

FIGS. 9A and 9B show the contact and separated states of the conveyer and transfer belt mechanism with respect to the transfer positions of the photosensitive drums.

Driving roller 214 and idle roller 215 between which conveyer and transfer belt 216 is wound and tensioned are fixed to a frame 300 so that the belt can move together with this frame 300. Other than the above, attached to this frame 300 are the aforementioned charging roller 228 for charging belt 216, a belt cleaner 301 for collecting the leftover toner on belt 216 surface, and the aforementioned transfer chargers 225*a* to 225*d*. These components also are moved as the conveyer and transfer belt mechanism, together with frame 300.

The conveyer and transfer belt mechanism is configured so that its position can be switched by actuation of a jammed sheet removing mechanism, provided thereunder, between the sheet conveying position shown in FIG. 9A at which conveyer and transfer belt 216 is in close contact with image forming stations Pa to Pd so as to permit the conveyance of sheet P and the jammed sheet removal position shown in FIG. 9B at which conveyer and transfer belt 216 is positioned lower than the sheet conveyance position, being kept away from image forming stations Pa to Pd.

The jammed sheet removing mechanism supports frame 300 at two sites. Illustratively, frame 300 has two depressed areas 300*a* on the underside thereof, at which support rollers 302 of the jammed sheet removing mechanism are engaged whilst being able to move within the depressed areas 300*a*.

Each support roller 302 is axially supported on a shaft provided for a supporting piece 304. These supporting pieces 304 are linked with each other by a linking mechanism 303 and each pivoted on an axle H so as to be rotatable in the actuated direction indicated by arrow C and in the reverse, returning direction.

In the figure, a handle (not shown) as a switching means is provided for left supporting piece 304, and as this handle is operated, the left supporting piece and right supporting piece 304 which is linked therewith by linking mechanism 303 rotate together, whereby the conveyer and transfer belt mechanism attached to frame 300 as a whole moves down to the lower jammed sheet removal position. Both end portions of frame 300 are fitted in the grooves formed on guide rollers 306, which is rotatably supported on axles. This arrangement assures that the conveyer and transfer belt mechanism only moves up and down without being displaced to the left and right or to the front and rear when frame 300 is moved up and down.

Expected reasons for moving, i.e., separating and resetting conveyer and transfer belt mechanism 213 with respect to the transfer positions of photosensitive drums 222*a* to 222*d* include: abnormal conveyance of the printing medium in the conveyance and transfer path, periodic check, parts replacement, adjustment and the like. In such events, the relationship of the stop-positions between the photosensitive drums may change.

For this reason, after such an event, for example, when the apparatus has its power activated, or when the conveyer and transfer belt mechanism is returned to the predetermined position, the above described control of the stop-positions of the photosensitive drums should be carried out.

Further, when an operation of continuous image outputs is performed, there is a possibility that the photosensitive drums which are set in a correct relationship in the initial stage may become out of order, little by little, as the time proceeds (continuous operation time becomes longer). To deal with this, the number of continuous outputs, the time of continuous outputs, etc., may be checked by means of internal counter, internal timer, etc., in the CPU so as to perform the stop-position control of the photosensitive drums when the count or the time reaches the predetermined level.

Further, color image forming apparatus 1 of this embodiment can reproduce monochrome or mono-color images using one of image forming units for black, yellow, magenta and cyan or their combination. In this case, in some configurations, only the needed recording portions may be operated while the others which are not engaged with the image reproduction may be stopped. For such an apparatus, it is also possible to configure the system so that the stop-position control of the photosensitive drums will be always performed after the performance of this kind of image forming operation.

For the stop-position control of the photosensitive drums in consideration of the distance between the transfer areas thereof, if the apparatus is configured so that the control is performed after the conveyer and transfer belt mechanism is temporarily retracted from the transfer positions of the photosensitive drums, this configuration is further effective, especially in preventing degradation of the photosensitive drum surfaces.

Next, the position control means of photosensitive drums 222*a* to 222*d* will be described.

Motor M used for controlling the position of each photosensitive drum is one which drives one individual photosensitive drum and can adjust the margin period of time (margin angle) for each photosensitive drum. For this purpose, a stepping motor or servomotor which is capable of performing precise position control is preferable.

Meanwhile, in the above configuration, if photosensitive drums 222*a* to 222*d* and conveyer and transfer belt 216 are set to always stop at the same positions in order to suppress the influence of the driving unevenness, the photosensitive drums will degrade due to local abrasion of their surfaces, leading to degradation of the image quality of the reproduction. This abrasion is caused by the frictional force arising due to the time lag at the start or stop of driving between each photosensitive drum and conveyer and transfer belt 216.

To deal with this, in addition to the above configurations, control in this embodiment is performed in such a manner that the stop-positions (the contact points at the stopped state with conveyer and transfer belt 216) of photosensitive drums (image bearers) 222*a* to 222*d* are shifted while keeping the predetermined phase angles from one to the next when the number of starts or stops of driving reaches the predetermined number of times (equal to or greater than one), whereby each photosensitive drum can be prevented from stopping with the same area of the drum surface abutting against conveyer and transfer belt 216 surface.

For the means for checking whether the number of starts or stops of driving reaches the predetermined number of times (equal to or greater than one), a usually used method, that is, the internal management counter in the microcomputer for control and management of the basic operation of the image forming apparatus, may be used. When reaching the predetermined number of times, the stop-positions are shifted by the predetermined amount (angle) so as to avoid a local point (area) on the surface of each photosensitive drum from being damaged intensively. A specific method will be described referring to FIG. 10.

Figure 10:
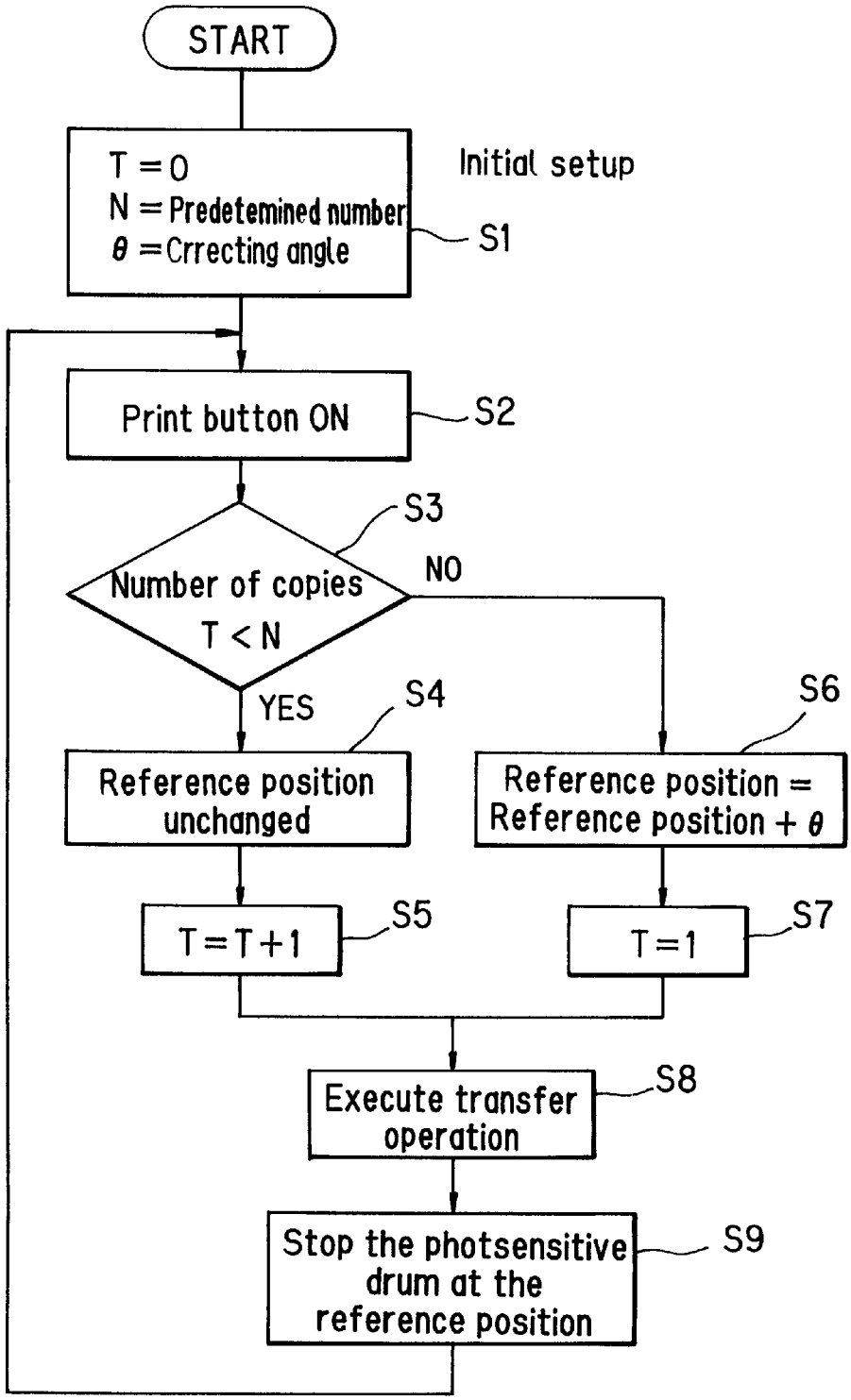
FIG. 10 is a flowchart for changing the stop-positions of the photosensitive drums in accordance with the embodiment of the invention.

FIG. 10 is a flowchart for illustrating the start-position control means of photosensitive drums 222*a* to 222*d*.

To begin with, when the photosensitive drums are mounted or replaced, the number of copies (transfer) T in a counting means in an unillustrated memory device or the like in controller CON shown in FIG. 7 is cleared and set to zero. The number of times for position switching N (the number can be set at one or above and altered as appropriate) and correcting angle θ (the angle can be altered as appropriate) are input (Step S1).

After all the photosensitive drums have been mounted, and when a copy operation is commanded through the control panel (not shown) of digital color copier 1 shown in FIG. 2 (the print switch is on: Step S2), the counting means compares the number of copies T with the number of times for position switching N (Step S3). If the comparison shows that the number of copies T is smaller than the number of times for position switching N (T<N), operation goes to Step S4. If the number of copies T is equal to the number of times for position switching N (T=N), operations goes to Step S6.

At Step S4, the margin period of time (angle) shown in FIG. 8 is not corrected and the number of copies T is increased by one (Step S5) and then a copying operation is performed (Step S8).

When operation goes to Step S6, the margin period of time (angle) is added with a correction angle 0 to set new margin period of time (angle), the number of copies T is cleared and set to 1 (step S7) and then a copying operation is performed (Step S8).

When the copying operation completes, each photosensitive drum stops with its own margin period of time (angle) to be ready for a next copy command through the control panel (Step S2).

In accordance with the scheme of the flowchart shown in FIG. 10 for controlling the start-positions of photosensitive drums 222*a* to 222*d*, the contact positions of the photosensitive drums with conveyer and transfer belt 216 in the their stopped state (standby state for copying operation) vary every time the number of copies reaches the predetermined number N. Therefore, it is possible to prevent a local point (area) on the surface of each photosensitive drum from being damaged intensively.

Here, the above flowchart shown in FIG. 10 is a mere example of the control scheme of altering the start-positions of the photosensitive drums. So the order etc., of the control steps may be changed to improve the efficiency. For example, in FIG. 10, the copying step (Step S8) is performed after the control steps (Steps S3, S4, S5, S6 and S7), but the copying step and the control steps may be carried out in parallel in order to increase the speed of operation.

As to the angle correction (Steps S4 and S6), not limiting as to the margin period of time, the angle correction may be performed by introducing a new variable, such as a correction angle in proportion to the number of copies T, and adding it to the initial reference positions.

The alternation of the start-position of the photosensitive drums can be performed efficiently by changing the margin periods of time after the stage where the copying operation of the photosensitive drums has been completed. However, for example, the start-positions may be altered independently of the copying operation by rotating the photosensitive drums only, or the photosensitive drums and the conveyer and transfer belt in synchronism, by the predetermined angles, after the completion of the predetermined number of copies or before the start of copying.

In connection with this, when the start-positions of the photosensitive drums are changed, if the photosensitive drums are rotated independently from the conveyer and transfers belt, it is preferable that the photosensitive drums be separated from the conveyer and transfer belt to prevent damage due to friction with the photosensitive drums.

Image forming apparatus 1 has a color image reproduction mode using multiple photosensitive drums and their transfer areas A and a monochrome image reproduction mode using the photosensitive drum for black imaging and its transfer area A. Therefore, in view of the transfer frequency, the photosensitive drum at the transfer area A for reproducing black images is considered to be abraded and damaged most intensively of all the four photosensitive drums.

Therefore, it is possible to configure the system so that the number of image formations by the recording portion for reproducing black images only is checked among the four photosensitive drums. In this case, when the number of image formations by the recording portion for reproducing black images reaches the predetermined number, the stop-positions of all the four photosensitive drums are shifted by the predetermined amount (angle) to thereby prevent a local point (area) on the surface of each photosensitive drum from being degraded intensively.

The description of this embodiment was made of an example of an image forming apparatus for forming a color image in which multiple photosensitive drums are arranged in parallel to each other with conveyer and transfer belt 216 abutted against the surfaces of these multiple photosensitive drums. However, the present invention is applicable to an image forming apparatus in which conveyer and transfer belt 216 is abutted against the transfer area of a single photosensitive drum.

Since the charging roller, developing roller, transfer roller etc., are also operated to produce effects on the photosensitive drum surface in synchronism with the rotational driving of the drum, it is also possible to change the stop-position of the photosensitive drum every time the number of copying operations reaches a predetermined number of times, taking into account the influences of these elements upon the photosensitive drum.

As has been described heretofore, sensors S1 to S4 are used to detect reference marks Q formed on the photosensitive drums so as to control their stop-positions. These sensors also detect the same reference marks Q to perform control of correcting the image forming conditions, for example, execute another sequence for creating toner patterns for image density adjustment on the photosensitive drums.

That is, controller CON includes two control means based on different sequences using the detection results (signals) from sensors S1 to S4. That is, the first control means controls the image forming process of photosensitive drums 222*a* to 222*d* while the second control means controls the stop-positions of the photosensitive drums so that they are stopped at the predetermined positions which are related to each other taking into account driving unevenness (the distance and phase-difference between photosensitive drums) and prevention of damage to the photosensitive drums. Each control sequence is automatically performed at their own predetermined timing.

In the above description, the control of the stop-positions of the photosensitive drums is performed by detecting the reference marks Q formed on the photosensitive drums. However, reference mark Q formed on the surface of conductive support member PMa of the photosensitive drum and coated by photoconductive layer PMb as shown in FIG. 4 may be used. In this case, the position of reference mark Q will not be limited so that it is possible to enhance the flexibility and efficiency of the control process and the apparatus.

Figure 11:
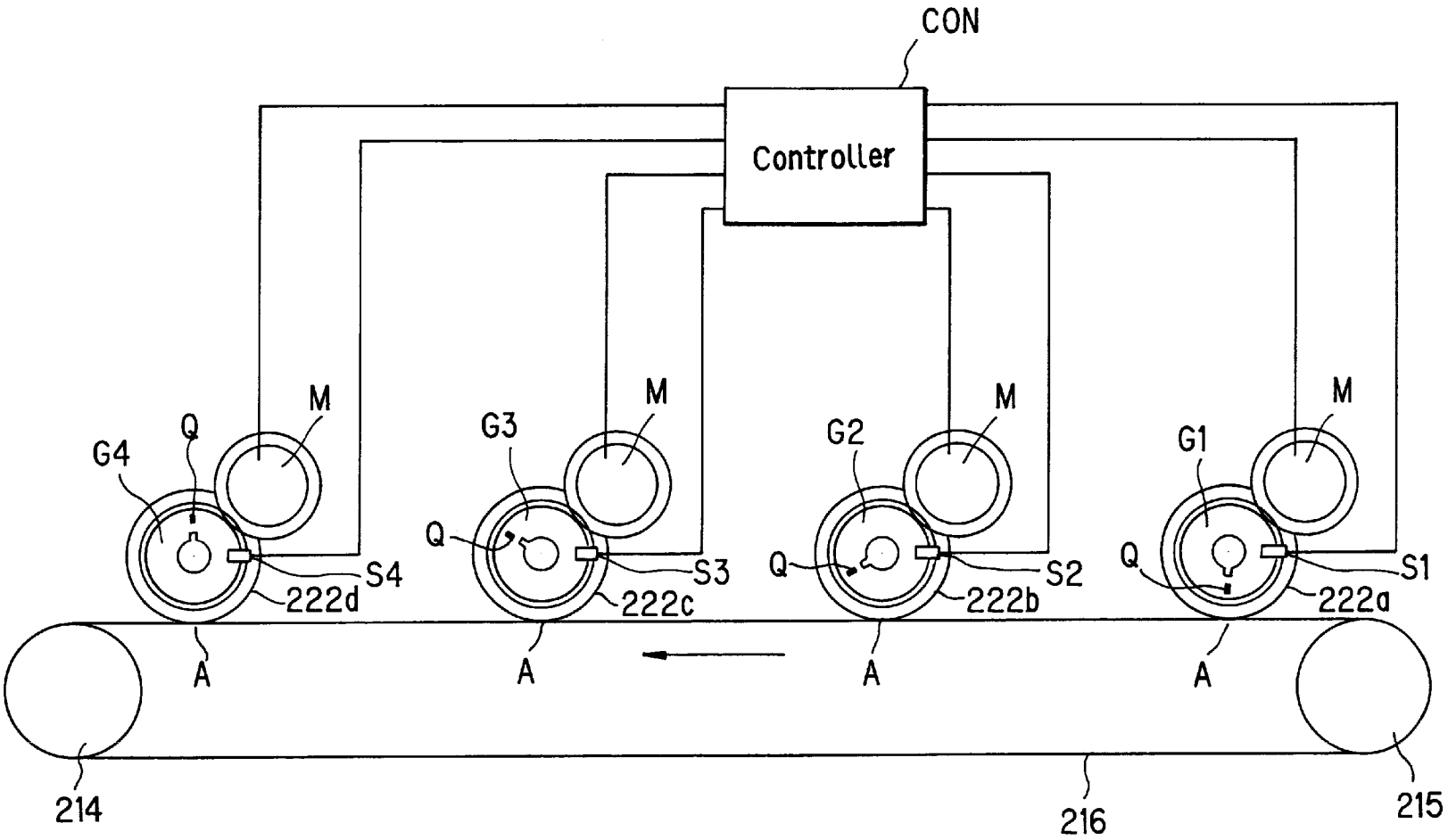
FIG. 11 is an illustrative view showing a control method of the photosensitive drums in accordance with the embodiment of the invention.

The above photosensitive drum has a gear G which transmits the rotational driving force thereto and rotates together therewith. Reference mark Q may be formed on this gear G so that this reference mark Q can be commonly used to control the stop-positions of the photosensitive drums and to perform control of correcting the image forming conditions. When reference marks Q are arranged in gears G of the photosensitive drums, sensors S1 to S4 are attached as shown in FIG. 11.

Next, the supporting method of the photosensitive drums to the shafts rotationally driven as already described will be explained with reference to FIGS. 12 and 13.

First, the configuration of photosensitive drums 222a to 222*d* and peripheral devices shown in FIG. 2 and the procedures of attachment to copier 1 will be described referring to a sectional side view of copier 1 shown in FIG. 12. Because FIG. 12 is a sectional side view, the description will be made explaining photosensitive drum 222*a*, but photosensitive drums 222*b* to 222*d* also have the same configuration.

Figure 12:
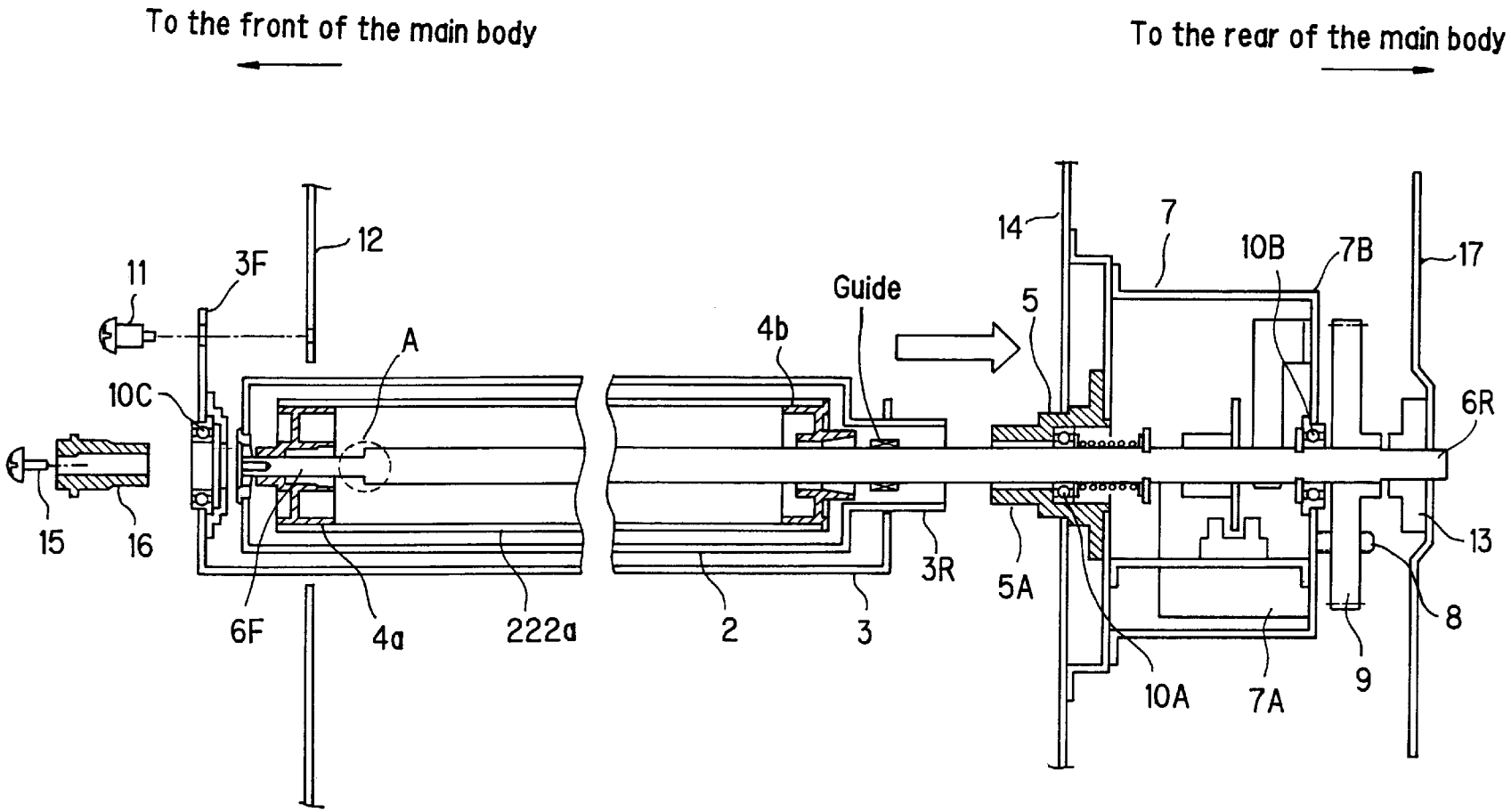
FIG. 12 is a sectional view for illustrating the mounting procedures of the photosensitive drum to copier 1 in accordance with the embodiment of the invention.

In FIG. 12, image forming station Pa (FIG. 2) is represented by a process unit 2 in which only photosensitive drum 222*a* is shown. The other parts, e.g., the charging device, developing device, cleaning device, etc., are not shown and the description of them is also omitted.

Cylindrical photosensitive drum 222*a* has a pair of flanges 4*a* and 4*b* fixed at both ends thereof. Shaft 6 is fitted and engaged through these drum flanges 4*a* and 4*b* at their center, extending along the length of photosensitive drum 222*a*. Photosensitive drum 222*a* in copier 1 body (FIG. 2) is positioned by penetration of shaft 6 or the like.

Each process unit 2 is set in a process unit supporting frame 3. For replacement of the unit due to its aging, process unit supporting frame 3 is pulled out from copier 1 body and the current process unit 2 to be replaced is replaced with a fresh process unit and then process unit supporting frame 3 is inserted again into the copier 1 body.

Next, description will be made of the configuration of the main body side to which process unit supporting frame 3 is attached. Driving force of a motor 7A of driving unit 7 is transferred to shaft 6 by way of a motor gear 8 and shaft gear 9. This shaft 6 is rotatably driven in the main body whilst being supported by a bearing 10A fixed to a rear frame 14 of the main body by means of a holder block 5 and a bearing 10B held by a frame 7B of driving unit 7.

A flywheel 17 for stabilizing the rotation of photosensitive drum 222*a* is supported at the right end part 6R of shaft 6 in FIG. 12 by means of a support member 13, so that shaft 6, once it began rotating, continues to rotate stably to some extent by the force of inertia.

Holder block 5 positions not only shaft 6 but also the aftermentioned process unit 2 so that the center of shaft 6 and the shaft center of process unit 2 are set aligned.

In order to meet this requirement, holder block 5 may be configured so as to equally enclose the circumference of shaft 6, thus making it possible to suffice the above requirement.

In this embodiment, holder block 5 is shaped in a cylindrical form matching the outline of shaft 6, to thereby easily set the center of shaft 6 and the shaft center of process unit 2 coaxial with the shaft center of holder block 5 and eliminate the oscillation due to an offset between shaft 6 and the shaft center of process unit 2.

Next, description will be made of the procedure of attaching process unit 2 to the main body side.

Process unit 2 is positioned so that a connecting opening 3R formed on the rear side (on the right side in FIG. 12) of process unit supporting frame 3 is fitted on a projected portion 5A of holder block 5 supported by a rear frame 14 while a connecting portion 3F on the front side (on the left side in FIG. 12) of process unit supporting frame 3 is fixed to a front frame 12 of main body 1 by means of a fixing screw 11.

Photosensitive drum 222*a* has shaft 6 fixed therein extending along the rotation axis and is positioned and held by attaching a shaft lock 16 into a bearing 10C arranged on the front side of process unit supporting frame 3 and then fixing a photosensitive drum fixing screw 15 to the front end of shaft 6.

In the front end 6F of shaft 6 on the left side in FIG. 12, the cylindrical shaft is formed as a key-shaped or D-shaped while the passage hole for shaft 6 on the drum flange 4*a* of photosensitive drum 222*a* is formed as a key-shaped hole or D-shaped hole so that photosensitive drum 222*a* is always held in a constant state with respect to shaft 6.

Drum flange 4*a* is press fitted to photosensitive drum 222*a*. In this case, for all the four drums, the key-shaped or D-shaped hole formed on drum flange 4*a* for receiving shaft 6 is fitted in the same relationship with respect to mark Q formed on each photosensitive drum 222.

In the above embodiment, process unit 2 and photosensitive drum 222*a* are positioned using fixing screw 11 for process unit supporting frame and photosensitive drum fixing screw 15, but it is easily understood that instead of these screws, a spring or any other locking device can be used to provide easy positioning for the user's sake.

Figure 13:
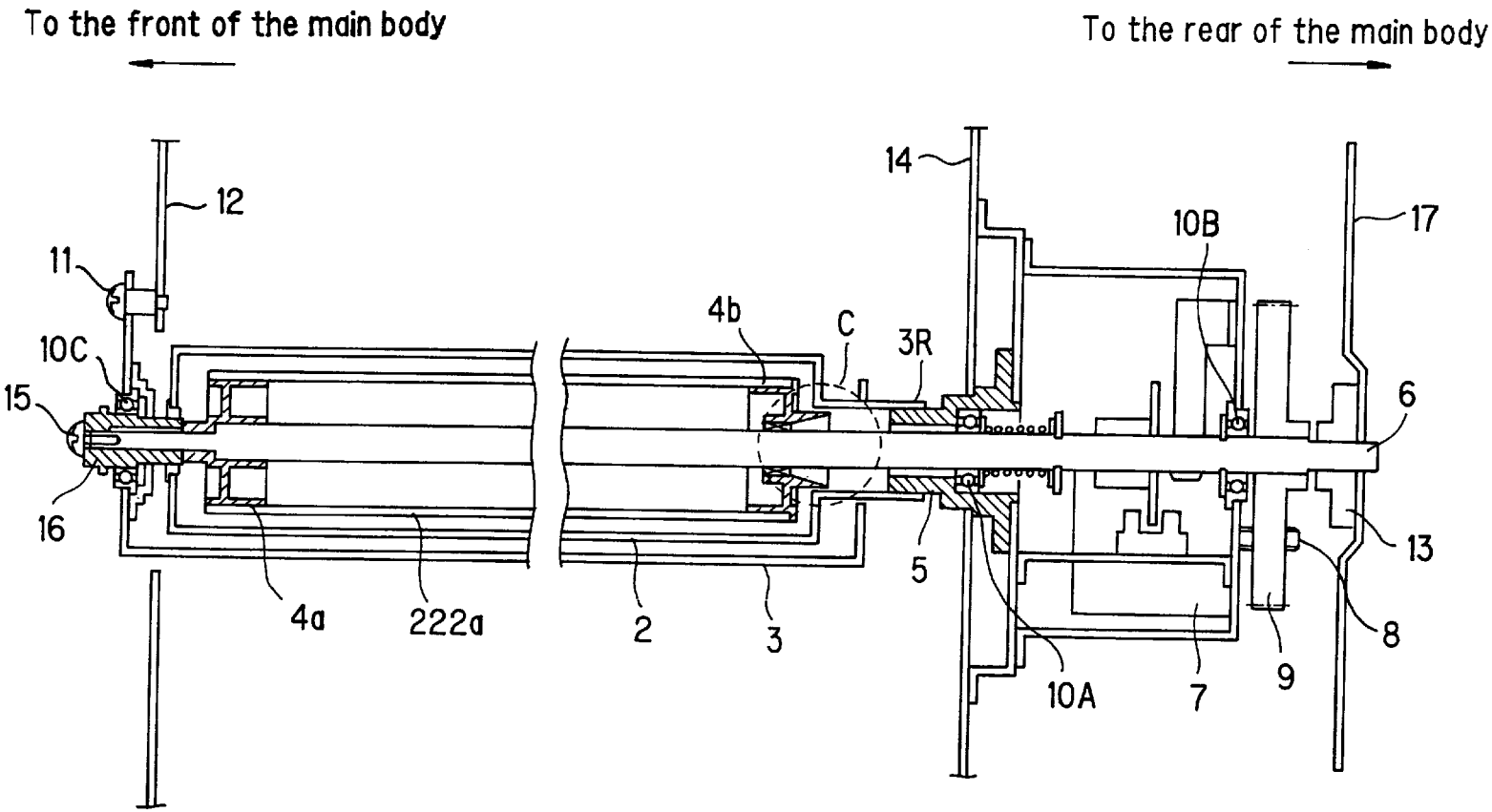
FIG. 13 is a sectional view for illustrating a photosensitive drum and its driving mechanism in accordance with the embodiment of the invention.

FIG. 13 shows the state where shaft 6 is engaged with photosensitive drum 222*a*. In FIG. 13, there is a clearance in the portion encircled by dashed line C, or in the adjoining portion between frame 3 of process unit 2 and drum flange 4*b* of photosensitive drum 222*a*.

That is, when drum flange 4*a* of photosensitive drum 222*a*, which has been put in a free state within a limited range (set in a loose state) in the process unit 2, is engaged with shaft 6 and then when drum flange 4*b* becomes supported by the guide provided on shaft 6, flanges 4*a* and 4*b* of photosensitive drum 222*a* are completely cleared from frame 3 of process unit 2 so as to eliminate the risk of the image blurring due to the transmission of vibrations and impacts against process unit 2 to photosensitive drum 222*a*.

In the above arrangement, first all photosensitive drums 222*a* to 222*d* are supported so as to be rotationally driven. Then photosensitive drums 222*a* to 222*d* are rotated so as to check the signals output from detection sensors Si to S4, to confirm whether each reference mark Q formed on the photosensitive drum surface can be detected.

When all the reference marks Q on photosensitive drums 222*a* to 222*d* can be detected by detection sensors S1 to S4, the aforementioned, drum stop-position control for the primary scheme is performed. If reference marks Q on photosensitive drums 222*a* to 222*d* cannot be detected by detection sensors S1 to S4, no drum stop-position control for the primary scheme will be performed.

With this configuration, when designated photosensitive drums 222*a* to 222*d* are set with the predetermined positional relationship where the distance between photosensitive drums are set and their phase angles are shifted taking into account driving unevenness, the photosensitive drums will be precisely stopped with their phase angles shifted from each other so as to be ready for a subsequent operation. On the other hand, if the photosensitive drums are attached in a wrong manner, a warning is issued. Alternatively, even when a wrong photosensitive drum other than that designated is placed, the image reproduction is continued though a proper image output by the correct control cannot be expected, so as not to offend the user.

In accordance with the invention defined as the first aspect, since the distance between the adjacent transfer stations is set shorter than the circumference of the image bearer, it is possible to make the apparatus compact as compared to the conventional configuration where N=1. Further, the phase angle of each image bearer is shifted out of phase from the others for compensating for the above shortening the distance between the adjacen transfer station, so that periodic, rotational driving unevenness of each image bearer produces the same variation with respect to the printing medium passing through the successive transfer stations. Therefore, the images formed on different image bearers can be sequentially superimposed under the same condition without having any influence of periodic driving unevenness of the image bearers. Hence, the final output image can be reproduced correctly without color misregistration.

In accordance with the invention defined as the second aspect, the aspect of the first invention can be easily attainted by controlling the driving of each image bearer based on its reference mark (any mark will make do as a reference such as a cutout in the gear shaft or the like) which enables identification of the phase of periodic driving unevenness of the image bearer.

In accordance with the invention defined as the third aspect, the following advantage can be obtained. In general, all the image bearers are started to rotate at the same time and stopped at the same time. This is to prevent the image bearers from being damaged by their friction with the printing medium-conveyance unit (conveyer and transfer belt). Even if the rotation of each image bearer is started and stopped at different timing from the others, there is no concern of the image bearers being damaged if the printing medium-conveyance unit is separated from the image bearers. However, this method entails a time loss. Therefore, since the phase of the rotational stop-position (which means the start-position for rotation) of each image bearer is shifted as above, it is possible to realize the driving method described in the first aspect in a simple manner.

In accordance with the invention defined as the fourth aspect, each image bearer is stopped at a position after a lapse of a period of time containing a predetermined margin period of time, instead of stopping it immediately after the detection of the reference mark. Therefore, the predetermined stop-state can be realized in a marginally minimized time (with a marginally minimized rotary angle).

In the above case, suppose that no margin period of time is reserved, if the amount of correction for a certain image bearer with respect to the reference image bearer is positive, the image bearer may be stopped after an extra rotation corresponding to the amount of correction. However, when the amount of correction is negative, the image bearer goes beyond the position to be stopped. So to stop the image bearer at the correct position, the image bearer need to be rotated one more revolution. As already stated, all the image bearers are started to rotate at the same time and stopped at the same time while the conveyer and transfer belt is continuously (other than the jammed paper removal) put in proximity to the image bearers, so that such a large rotation will produce marked damage to the surfaces of the image bearers. Thus, the above configuration is able to set the apparatus into the stand-by state which enables an ideal recording of an image in a short period while suppressing damage to the surface of each image bearer, making it possible to perform smooth recording of a subsequent image.

In accordance with the invention defined as the fifth aspect, use of a simple configuration positively enables each image bearer to be stopped in a suitable state.

In accordance with the invention defined as the sixth aspect, the positional relationship between the adjoining transfer stations can be corrected by adjusting the stop-position of the image bearer facing the transfer station downstream. Similarly, even if the positional relationship between the detectors for detecting the reference marks is disordered, it is possible to adjust and correct the stop-position of the image bearer for which the detector is displaced, in a similar manner.

In accordance with the invention defined as the seventh aspect, if there occurs a factor that varies the stop-position of the image bearer in each recording portion, the image bearer in each recording portion is controlled so as to be stopped at the predetermined stop-position. Therefore, the image bearer in each recording portion is stopped and set in the appropriate stop-position before the recording of an image is started so that for subsequent operations the image of each component color can be exactly superimposed over the others without being affected by periodic, driving unevenness, thus making it possible to reproduce a correct color image.

In accordance with the invention defined as the eighth aspect, the image bearer in each recording portion is controlled so as to be stopped at the predetermined stop-position when the power to the apparatus is activated. Therefore, the image bearer in each recording portion is always stopped and set in the appropriate stop-position before recording of an image is permitted so that for subsequent operations the image of each component color can be exactly superimposed over the others without being affected by periodic, driving unevenness, thus making it possible to reproduce a correct color image. Further, the apparatus can start recording of an image in a suitable condition as soon as it becomes prepared for recording.

In accordance with the invention defined as the ninth aspect, the image bearer in each recording portion is controlled so as to be stopped at the predetermined stop-position after the periodic check (after parts replacement, unit adjustment, etc.). Therefore, whenever the periodic check such as parts replacement, unit adjustment or the like, which is highly likely to cause variations in the stop-positions, has been done, the image bearer in each recording portion is stopped and set in the appropriate stop-position so that for subsequent operations the image of each component color can be exactly superimposed over the others without being affected by periodic, driving unevenness, thus making it possible to reproduce a correct color image. Further, the apparatus can start recording of an image in a suitable condition as soon as it becomes prepared for recording.

In accordance with the invention defined as the tenth aspect, the image bearer in each recording portion is controlled so as to be stopped at the predetermined stop-position after removal of abnormally fed printing medium. Therefore, it is possible to configure the driving mechanism so as to be temporarily released to facilitate easy removal of the printing medium that caused paper jamming, from the conveyance path without giving damage to the image bearer surfaces, and after the removal, the image bearer in each recording portion is always stopped and set in the appropriate stop-position so that for subsequent operations the image of each component color can be exactly superimposed over the others without being affected by periodic, driving unevenness, thus making it possible to reproduce a correct color image.

In accordance with the invention defined as the eleventh aspect, the image bearer in each recording portion is controlled so as to be stopped at the predetermined stop-position after the release of the printing medium-conveyance unit. Therefore it is possible to provide a configuration which permits easy removal of the printing medium that caused paper jamming from the conveyance path, and after the removal, the image bearer in each recording portion is always stopped and set in the appropriate stop-position so that for subsequent operations the image of each component color can be exactly superimposed over the others without being affected by periodic, driving unevenness, thus making it possible to reproduce a correct color image.

In accordance with the invention defined as the twelfth aspect, the image bearer in each recording portion is controlled so as to be stopped at the predetermined stop-position every predetermined times of image recording. Therefore it is possible to minimize (correct) the misregistration, due to periodic driving unevenness of the image bearer in each recording portion, increasing as recording proceeds. As a result, the image of each component color can be exactly superimposed over the others without being affected by periodic, driving unevenness, thus making it possible to reproduce a correct color image.

In accordance with the invention defined as the thirteenth aspect, the image bearer in each recording portion is controlled so as to be stopped at the predetermined stop-position after image formation has been performed with at least one of a plurality of recording portions stopped. Therefore, after image recording using part of the multiple recording portions, the image bearer in each recording portion is stopped and set in the predetermined stop-position so that for subsequent operations the image of each color developer can be exactly superimposed over the others without being affected by periodic, driving unevenness, thus making it possible to reproduce a correct color image.

In accordance with the invention defined as the fourteenth aspect, the image bearer in each recording portion is controlled so as to be stopped at the predetermined stop-position after image formation of black developer has been performed. Therefore, after image recording using part (the black image recording portion) of the multiple recording portions, the image bearer in each recording portion is stopped and set in the predetermined stop-position so that for subsequent operations the image of each color developer can be exactly superimposed over the others without being affected by periodic, driving unevenness, thus making it possible to reproduce a correct color image.

In accordance with the invention defined as the fifteenth aspect, since the printing medium-conveyance unit is retracted from the image bearers in the recording portions when the image bearer in each recording portion is controlled to stop at the predetermined stop-position, the conveyer and transfer belt is separated from the image bearer surfaces so as to minimize the load acting on the image bearer surface of each recording portion, thus making it possible to make sure the stop-position of each image bearer. This configuration also contributes to prevention of damage (scratching) to the image bearer surfaces.

In accordance with the invention of the sixteenth aspect, since damage to the image bearer surface will not concentrate at a local area, it is possible to use the image bearer more efficiently and improve the maintainability as well as lengthen the product life of the image bearer.

In accordance with the invention of the seventeenth aspect, for the case where multiple image bearers are used, the developer images sequentially superimposed can be laid over one another without misregistration by harmonizing the behavior of periodic, rotational driving unevenness of each image bearer with that of the others. Accordingly, it is possible to reproduce a correct color image without color misregistration. Further, when the distance between the image bearers are set shorter than the circumference of the image bearer, the apparatus can be made compact.

In addition, since the abutment position of the surface of each image bearer against the printing medium-conveyance unit is varied, damage to the image bearer surface will not concentrate at a local area. Therefore, it is possible to use the image bearer more efficiently and improve the maintainability as well as lengthen the product life of the image bearer.

In accordance with the invention of the eighteenth aspect, on the basis of the image bearer of which the surface is likely to be most severely damaged, the abutment positions of all the image bearers are changed from the first ones to the second ones. Therefore, it is possible to use the image bearers in a more appropriate and efficient manner and hence lengthen the product lives of the multiple image bearers.

In accordance with the invention of the nineteenth aspect, since the abutment position of the surface of the image bearer against the printing medium-conveyance unit is A changed every predetermined number of stops or starts of driving, the abutment position will be changed from one to the next before the surface areas of the image bearer and of the printing medium-conveyance unit are locally damaged. Therefore, rubbing of the surfaces of the image bearer with the printing medium-conveyance unit arising due to the time lag at the start or stop of driving between the image bearer and the printing medium-conveyance unit will not concentrate at one point.

Therefore, it is possible to use the image bearer in a more appropriate and efficient manner and hence lengthen the product live of the image bearer.

In accordance with the invention defined as the twentieth aspect, since the control means performs control in such a manner that the abutment position of the surface of each image bearer against the printing medium-conveyance unit at the start of driving is changed every predetermined number of stops or starts of driving, damage to the image bearer surfaces will not concentrate at a local area. Therefore, it is possible to use the image bearer more efficiently and improve the maintainability as well as lengthen the product life of the image bearer.

In accordance with the invention of the twenty-first aspect, since both the first control means for controlling the image forming process and the second control means for controlling the stop-position of the image bearer are configured to perform their control based on the common sensor detecting the reference mark, the cost can be reduced without the need to provide a dedicated sensor for each, Further, since the image bearer is stopped at the predetermined position by directly detecting the reference mark which rotates in harmony with the rotation of the rotationally driven image bearer, it is possible to precisely stop the image bearer with the desired relationship taking into account driving unevenness as well as damage to the image bearer, etc.

In accordance with the invention of the twenty-second aspect, since the reference mark which is attached on the surface of the rotationally driven image bearer is directly detected so as to stop the image bearer at the predetermined position, it is possible to precisely stop the image bearer every time, with the desired relationship taking into account driving unevenness as well as damage to the image bearer, etc.

In accordance with the invention of the twenty-third aspect, since the reference mark is coated by the photoconductive layer, it is less damaged. Since the position of attachment is not limited, it is possible to enhance the flexibility of the position of attachment of the sensor.

In accordance with the invention of the twenty-fourth aspect, since the reference mark which is attached on a drive transmission member for transmitting a rotational driving force to the image bearer is directly detected so as to stop the image bearer at the predetermined position, it is possible to precisely stop the image bearer every time, with the desired relationship taking into account driving unevenness as well as damage to the image bearer, etc.

In accordance with the invention of the twenty-fifth aspect, since the stop-position of the image bearer is altered periodically every predetermined number of copiers and/or after a lapses of a predetermined period of time, the position of the image bearer in contact with other parts is changed periodically so that it is possible to prevent the image bearer surface from being damaged locally, and hence lengthen the life of the image bearer.

In accordance with the invention of the twenty-sixth aspect, since the image bearer is supported in the predetermined relationship with respect to the driving mechanism and hence the behavior of periodic rotational driving unevenness of the rotationally driven image bearer will fall within the expected range, it is possible to take reliable countermeasures against the rotational driving unevenness.

In accordance with the invention of the twenty-seventh aspect, it is possible to check whether the image bearer is supported in the predetermined relationship with the driving mechanism in consideration of the driving unevenness, while for subsequent operations the stop-position of the image bearer can be controlled keeping the predetermined relationship.

In accordance with the invention of the twenty-eighth aspect, when designated image bearers are set with the predetermined positional relationship taking into account driving unevenness, the image bearers can be precisely stopped in the predetermined relationship. If the image bearers are attached in a wrong manner or a wrong image bearer other than that designated is placed, the image reproduction is continued to output an image whatever it image instead of completely stopping the machine, so as not to offend the user.

What is claimed is:

1. An image forming apparatus wherein images formed on the surfaces of multiple image bearers arranged in parallel to each other and rotationally driven are sequentially transferred in a superimposed manner to a printing medium conveyed by a printing medium-conveyance unit at transfer stations each set up for individual image bearers, characterized in that the distance between adjoining transfer stations is set shorter than the circumference of the image bearer and each image bearer is rotationally driven such that phase of rotational driving unevenness of each image bearer is shifted for compensating for the shortening of the distance between transfer stations so that periodic, rotational driving unevenness of each image bearer produces the same variation with respect to the printing medium passing through the transfer station, wherein each of the image bearers or each of the rotating members rotating in harmony with the rotation of the image bearer has a reference mark which enables identification of the phase of periodic driving unevenness of the image bearer, further comprising a controller for controlling rotational driving of all of the image bearers based on the reference marks.

2. The image forming apparatus according to claim 1, wherein the controller stops rotations of individual image bearers at their respective stop-positions based on the reference marks and starts rotations of all the image bearers simultaneously.

3. The image forming apparatus according to claim 2, further comprising: detectors for detecting the reference marks, wherein each detector is arranged in the same geometry with respect to the corresponding transfer station, characterized in that the controller detects the reference mark of one image bearer as a reference for positioning and stops the reference image bearer at a point when a predetermined margin period of time has elapsed after the detection of the reference mark of the reference image bearer, and detects the reference marks of the other image bearers so as to determine the amounts of correction by comparing the time at which each detector detects its reference mark with the time at which the reference mark of the reference image bearer is detected, and stops each image bearer at a point when the sum of the predetermined margin period of time and the amount of correction has elapsed.

4. The image forming apparatus according to claim 2 or 3, wherein each image bear is provided with an individual driver source for driving its rotation independently from the others and each driver source uses a stepping motor or servomotor.

5. The image forming apparatus according to claim 2, 3 or 4, wherein a stop-position adjuster for adjusting the stop-position of each image bearer is provided separately.

6. An image forming apparatus wherein images formed on the surfaces of multiple image bearers arranged in parallel to each other and rotationally driven are sequentially transferred in a superimposed manner to a printing medium conveyed by a printing medium-conveyance unit at transfer stations each set up for individual image bearers, characterized in that the distance between adjoining transfer stations is set shorter than the circumference of the image bearer and each image bearer is stopped such that phase of rotational driving unevenness of each image bearer is shifted for compensating for the shortening of the distance between transfer stations so that periodic, rotational driving unevenness of each image bearer produces the same variation with respect to the printing medium passing through the transfer station, a controller is provided which controls each image bearer so that each image bearer will stop at the predetermined stop-position when there occurs a factor that varies the stop-positions of the image bearers.

7. The image forming apparatus according to claim 6, wherein the factor that varies the stop-positions of the image bearers is the case where the power to the apparatus is activated.

8. The image forming apparatus according to claim 6, wherein the factor that varies the stop-positions of the image bearers is the periodic check of the apparatus.

9. The image forming apparatus according to claim 6, wherein the factor that varies the stop-positions of the image bearers is the case where an abnormally fed printing medium within the apparatus is removed.

10. The image forming apparatus according to claim 6, wherein the factor that varies the stop-positions of the image bearers is the case where the printing medium-conveyance unit has been separated and returned with respect to the image bearer surfaces.

11. The image forming apparatus according to claim 6, wherein the factor that varies the stop-positions of the image bearers is the case where the predetermined number of image recording operation has been performed.

12. The image forming apparatus according to claim 6, wherein image formation is performed in a mode which uses at least one of a plurality of recording portions, and the controller controls so that the image bearer in each recording portion stops at the predetermined stop-position after recording of an image using at least one of a plurality of recording portions.

13. The image forming apparatus according to claim 12, wherein the controller controls so that the image bearer in each recording portion stops at the predetermined stop-position after recording of an image using the recording portion for image recording of a black developer.

14. The image forming apparatus according to claim 6, wherein the controller controls so that the image bearer in each recording portion stops at the predetermined stop-position with the printing medium-conveyance unit retracted from the image bearers.

15. An image forming apparatus comprising: a rotationally driven image bearer; and a printing medium-conveyance unit abutted against the image bearer, wherein a developer image formed on the image bearer is transferred to a printing medium by passing the printing medium through the nip between the printing medium-conveyance unit and the image bearer, characterized in that a first abutment position on the surface of the image bearer against the printing medium-conveyance unit when the image bearer starts rotating differs from a second abutment position on the surface of the image bearer against the printing medium-conveyance unit when the image bearer stops rotating.

16. An image forming apparatus comprising: a multiple number of rotationally driven image bearers; and a printing medium-conveyance unit abutted against the image bearers forming transfer stations, wherein developer images formed on the image bearers are transferred to a printing medium passing through the transfer stations so that the images are sequentially superimposed, characterized in that each image bearer is rotationally driven such that phase of rotational driving unevenness of each image bearer is shifted from others so that periodic, rotational driving unevenness of the image bearer produces the same variation as that of the others with respect to the printing medium passing through the transfer stations, and a first abutment position on the surface of each image bearer against the printing medium-conveyance unit when the image bearer starts rotating differs from a second abutment position on the surface of the image bearer against the printing medium-conveyance unit when the image bearer stops rotating.

17. The image forming apparatus according to claim 16, wherein the first abutment position of the image bearer of which the surface is likely to be most severely damaged among all the image bearers is set different from the second abutment position while the rest image bearers are stopped with their phases shifted from each other in the predetermined relationship.

18. The image forming apparatus according to any one of claims 15 to 17, wherein the first and second abutment positions are altered every predetermined number of stops or starts of driving of the plural image bearers.

19. An image forming apparatus comprising: a rotationally driven image bearer; and a printing medium-conveyance unit abutted against the image bearer, wherein a developer image formed on the image bearer is transferred to a printing medium by passing the printing medium through the nip between the printing medium-conveyance unit and the image bearer, a controller is provided which controls the rotation of the image bearer in such a manner that the abutment position on the surface of the image bearer against the printing medium-conveyance unit when the image bearer starts rotating is altered every time the predetermined number of stops or starts of driving of the image bearer is reached.

20. An image forming apparatus comprising:

a first controller having a sensor which detects a reference mark rotating in harmony with the rotation of an image bearer and controlling the image forming process for the image bearer based on the detected result from the sensor; and a second controller controlling the stop-position of the image bearer based on the detected result from the sensor so that the reference mark is positioned in the predetermined relationship with respect to the sensor.

21. The image forming apparatus according to claim 20, wherein the reference mark is attached on the image bearer surface.

22. The image forming apparatus according to claim 21, wherein the reference mark is attached between a conductive supporting member and photoconductive layer constituting the image bearer.

23. The image forming apparatus according to claim 20, wherein the reference mark is attached on a drive transmission member for transmitting a rotational driving force to the image bearer.

24. The image forming apparatus according to claim 20, further comprising a controller for switching the stop-position of the image bearer, periodically.

25. The image forming apparatus according to claim 20, further comprising a driving mechanism for supporting the image bearer and transmitting a rotational driving force to the image bearer, wherein the image bearer is supported in the predetermined relationship with respect to the driving mechanism.

26. The image forming apparatus according to claim 25, further comprising a checking member for checking whether the sensor can detects the reference mark attached on the image bearer when a new image bearer is supported with respect to the driving mechanism.

27. The image forming apparatus according to claim 25 or 26, wherein when the sensor detects the reference mark attached to the image bearer, the image bearer stop-position control by the second controller is performed whereas if the sensor cannot detect the reference mark, the image bearer stop-position control by the second controller will not be performed.

* * * * *